US007267342B2

(12) United States Patent
Myrfors et al.

(10) Patent No.: US 7,267,342 B2
(45) Date of Patent: Sep. 11, 2007

(54) GAMES AND METHODS OF PLAYING GAMES WITH COLLECTABLE GAME COMPONENTS

(75) Inventors: Jesper Myrfors, Snohomish, WA (US); Paul Peterson, Kent, WA (US)

(73) Assignee: Hidden City Games, LLC, Seattle, WA (US)

( * ) Notice: Subject to any disclaimer, the term of this patent is extended or adjusted under 35 U.S.C. 154(b) by 0 days.

(21) Appl. No.: 11/080,110

(22) Filed: Mar. 14, 2005

(65) Prior Publication Data

US 2005/0258598 A1 Nov. 24, 2005

Related U.S. Application Data

(60) Provisional application No. 60/643,803, filed on Jan. 14, 2005, provisional application No. 60/573,200, filed on May 20, 2004.

(51) Int. Cl.
*A63F 3/00* (2006.01)

(52) U.S. Cl. ..... 273/288; 273/236

(58) Field of Classification Search ..... 273/288; 473/588

See application file for complete search history.

(56) References Cited

U.S. PATENT DOCUMENTS

| | | | | |
|---|---|---|---|---|
| 3,573,869 | A * | 4/1971 | Duckett | 473/588 |
| 4,055,343 | A * | 10/1977 | Stuart | 273/108 |
| 4,666,160 | A | 5/1987 | Hamilton | |
| 5,110,139 | A * | 5/1992 | Baumgartner | 273/400 |
| 5,125,669 | A * | 6/1992 | Kanda | 273/348 |
| 5,265,885 | A * | 11/1993 | Blount | 273/348.3 |
| 5,443,270 | A | 8/1995 | Loritz | |
| 5,662,325 | A * | 9/1997 | Weyand | 273/138.1 |
| 6,932,344 | B1 * | 8/2005 | Soto | 273/400 |

* cited by examiner

*Primary Examiner*—Vishu K. Mendiratta
(74) *Attorney, Agent, or Firm*—DWC Law Firm, P.S.; David Chen

(57) ABSTRACT

Various game embodiments and methods of playing the same comprising a plurality of game components that can be projected onto a surface. The game components can have a plurality of indicia thereon with some indicia being determinative of how a particular game component can interact with other game components and some indicia signifying a distance within which a game component must be deployed to another game component in order for the game component to affect the another game component.

30 Claims, 16 Drawing Sheets

GAMES AND METHODS OF PLAYING GAMES WITH COLLECTABLE GAME COMPONENTS

CROSS-REFERENCE TO RELATED APPLICATIONS

This application claims the benefit of U.S. Provisional Patent Application No. 60/643,803 filed Jan. 14, 2005 and U.S. Provisional Patent Application No. 60/573,200 filed May 20, 2004, both of which are incorporated herein by reference in their entireties.

BACKGROUND OF THE INVENTION

1. Field of the Invention

The present invention relates to various embodiments of games and methods of playing the same with collectable game components that can be projected onto a playing surface, with associated rules related to indicia on the game components, as well as alternative embodiments of the same that can be implemented in a computer or other electronically displayable format.

2. Description of Related Art

Games having collectable components are popular among a plurality of age groups in the United States and abroad. Examples include trading card games having rules and methods of play. These trading cards can typically incorporate artistic renditions of imaginary characters, events and objects or other subject matter related to the game. In addition, these trading cards commonly have indicia thereon indicating game information or parameters for the particular trading card. The indicia can be referenced by players in connection with game rules to determine an outcome or result of a game event or interaction between cards during play.

In an age when electronic games abound that can be played in isolation, trading card games have been praised for promoting social interaction between players, especially between children and young adults. Furthermore, many trading card games provide the opportunity for players to evaluate and devise complex strategies during play and to negotiate with one another during trading of the cards.

Nonetheless, a drawback of trading card games is that they do not incorporate manual dexterity or physical aspects of some other games, despite often being playable and enjoyed for hours on end. For example, some traditional games, such as horseshoes, marbles and darts, to name a few, provide more physical or dexterous game play that is lively and animated. However, conversely, those games lack the characteristics of some collectable games that have made collectable games so attractive to a wide variety of consumers.

BRIEF SUMMARY OF THE INVENTION

In some embodiments of the present invention a game with game components (e.g., game pieces, tokens or game chips) having ranges associated therewith are disclosed. The ranges can be indicated on the game pieces by indicia and the ranges can be different between one or more the game pieces.

During game play, players may take turns deploying game pieces by projecting them onto a playing surface. The playing surface can be a tabletop, desktop, floor, or other surface, including playing surfaces designed for use with the present invention. "Projecting" the game pieces can include, without limitation, throwing, tossing, rolling, blowing, kicking, sliding, ejecting, dropping or bouncing the game pieces onto the playing surface. After each player's turn, players can determine whether the distance between the most recently deployed game piece and another game piece is less than, equal to, or greater than a range associated with at least one of the game pieces. In some embodiments of the present invention, range indicia on the game pieces signify a distance within which a game piece must be deployed to another game piece in order to have an effect on the other game piece or to otherwise interact with the other game piece.

An interaction (such as an effect of one game piece on another game piece, or the way a game piece affects play) can be a function of certain indicia on the game pieces. Some game pieces can have indicia that signify characteristics, capacities, point values, and defense values, all of which provide information on how the game pieces interact with, or affect, other game pieces when deployed within range of the other game pieces. One or more of the indicia on the game pieces can be cross-referenced to a rule set or rule booklet, associated with the game, the rule set providing the above information about various indicia on the plurality of different game pieces. Different indicia can be provided for different game pieces so that various game pieces can interact differently.

The range indicia on the game pieces can be unitless numerical values so that players may select any measurement unit. For example, if the surface area of play is large, such as on a street or large floor, the range values can signify larger units of measurement, (e.g., feet) while on a smaller surface area of play, such as a tabletop, the range values can be treated as signifying smaller units of measurement (e.g., inches). In other embodiments, the range values can signify or be equated to other units of measurement, the units of measurement being traditional English units or metric units, or other tradition or non-traditional units of measurement.

One or more measurement devices or measurement elements can be provided for use in measuring distances between game pieces to determine whether they are within range of one another. The measurement devices, such as tape measures or other elongated members, can have markings or distance indicia, spaced apart thereon. In other embodiments, a playing surface can have distance markings that may be usable to assess distance between game pieces in comparison with the ranges of the game pieces.

The game pieces can comprise artistic illustrations and can be collectable and tradable. A player may acquire a large collection through purchase or trading, and may play with a playing-group (or playing stack) selected from her or his collection, with the playing group comprising a predetermined number of pieces during game play. The predetermined number of pieces in the playing group can be designated in a rule set or decided upon by players. Different rule sets can be provided. In some preferred embodiments, a single rule set is used for any given tournament or game.

In some embodiments, the object of the game is to retain or acquire the highest number of points. Game pieces may have point indicia and the players take turns deploying all game pieces within their playing-groups. The point indicia can indicate initial point values for the game pieces. However, upon deployment of each game piece, the players can determine whether interactions between the game pieces occur and apply the appropriate effects if they do, some of the effects resulting in reduction, increase, or elimination of point values for a player's game pieces. When all game pieces are deployed each player can take an accounting of the total number of points associated with the player's deployed game pieces, subject to the increases or decreases incurred during play. The player with the highest number of points can be declared the victorious player.

BRIEF DESCRIPTION OF SEVERAL VIEWS OF THE DRAWINGS

FIG. 1*a* shows a game piece having both "Attack" and "Shield" characteristics with a capacity indicia associated with the Attack characteristic. FIG. 1*q* shows an embodiment of a game piece having a field to which a figurine can be coupled or be integral therewith.

FIG. 3*a* shows an embodiment of a game chip with a plurality of fields outlined in dotted line wherein various indicia can be illustrated. FIG. 3*b* shows an example game chip having a defense value indicia and a range indicia. FIG. 3*c* depicts a game chip with a "Boost" characteristic. FIG. 3*d* depicts a game chip, with circular markings or dots, usable as point value indicators for the game chip. FIG. 3*e* shows another embodiment of the game chips with no point value indicators. FIG. 3*f* depicts a game chip having an "Ambush" characteristic. FIG. 3*g* shows a game chip having a both a "Move" characteristic and a "Strike" characteristic, and also having capacity indicia associated with each of the characteristics. FIG. 3*h* shows a game chip having a "Stop" characteristic. FIG. 3*i* shows a game chip having both a "Place" characteristic and a "Strike" characteristic, with the Strike characteristic having an associated capacity indicia of three (3).

DETAILED DESCRIPTION OF THE INVENTION

In the following description, certain specific details are set forth in order to provide a thorough understanding of various embodiments of the invention. However, upon reviewing this disclosure one skilled in the art will understand that the invention may be practiced without many of these details. In other instances, well-known structures and materials of construction associated with game pieces or components, such as game chips, tokens and discs, and various materials used to make the game pieces or other game components have not been described in detail to avoid unnecessarily obscuring the descriptions of the embodiments of the invention. Also, not all possible combinations of indicia associated with the game components are illustrated in the attached drawings, and some of the drawings have dotted line representations of fields for indicia, or indicia. The drawings are intended only to be examples and are in no way exhaustive as to the various possible combinations of indicia or there respective locations on the game components, as will be appreciated by those skilled in the art upon review of this disclosure.

The discussion below discloses, among other things, playing the present game inventions in the context of imaginary battles between armies in an alternate world wherein the players stand in the role of generals deploying troops and weapons into battle. However, as will be understood by one skilled in the art after reviewing this disclosure various other contexts or themes are contemplated without intent to be limiting.

The terms "project" or "projecting" as used herein, describe imparting motion to game pieces by, inter alia, casting, thrusting, tossing, throwing, kicking, sliding, bouncing, dropping, blowing, rolling or ejecting the game pieces. The term "game component," as used herein, includes, among other things, game chips, game pieces, game tokens, and discs that can be projected onto a playing surface in some embodiments of the present invention.

Various embodiments of the present game invention comprise game components that can be projected onto a playing surface and methods of play suitable for one or more players. The players may compete against one another to establish or maintain the highest score at the end of a set of game turns. Each of the players may play with a group of game pieces, or a playing-group (or playing stack) selected by each player from a collection of game pieces. Each player may have her or his own collection of game pieces acquired by purchase or trading of the game pieces.

Figure 1A:
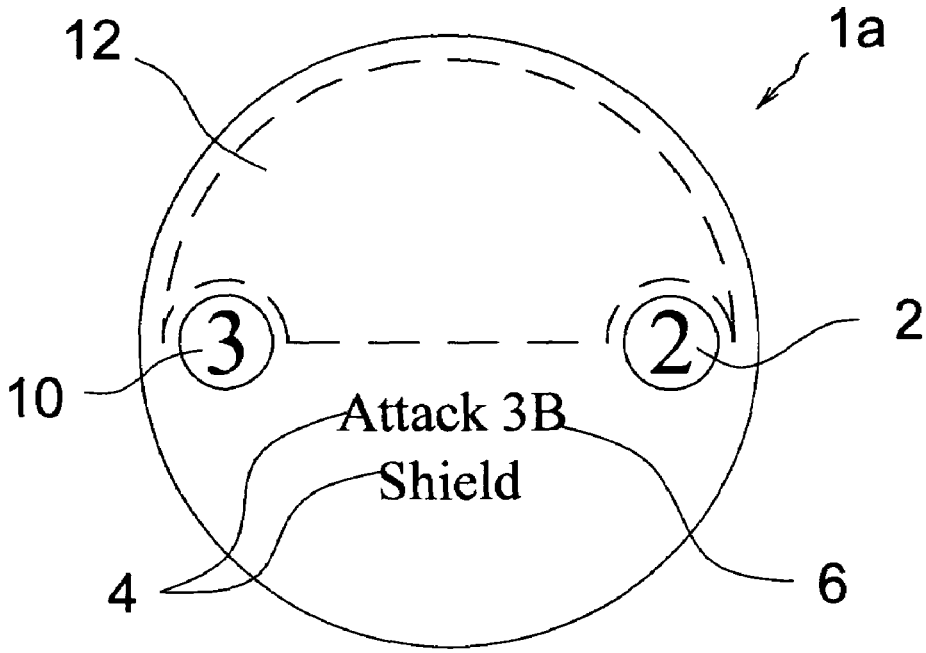
FIGS. 1*a* through 1*q* are overhead plan views of various game components for some embodiments of the present invention.

The game pieces that comprise the playing-group may differ from player to player, however, in some embodiments, all of the game pieces can be used for game play in accordance with a single rule set associated with one or more embodiments of the game disclosed herein. Some examples of game pieces for the present invention are illustrated in FIG. 1*a* though FIG. 1*q*. The game pieces can be, inter alia, poker-style game chips, such as those commonly used in connection with playing card games, or discs having various game relevant indicia 2, 4, 6, 10 marked thereon. The game pieces may comprise any of a myriad of materials of composition available for the manufacture of toys and games, such as, without limitation, plastics, clay composites and rubbers of various types as will be appreciated by those skilled in the art. The game pieces may be flexible or bendable, or substantially non-flexible or non-bendable material.

Some game pieces incorporate artistic renditions (not shown) of characters, objects, events or other subject matter related to a theme of the game, and trademarks or brands (not shown). The artistic renditions can be placed in various locations on the game pieces, such as, for example, in the field 12 of the game pieces 1*a*-1*q* shown in FIG. 1*a*-FIG. 1*q*. In addition, the artistic renditions can also be, without limitation, figures, figurines, or miniature sculptures depicting objects, persons or characters in popular culture and can be coupled to the game pieces in field 12, such as on game piece 1*q* in FIG. 1*q*.

Figure 1B:
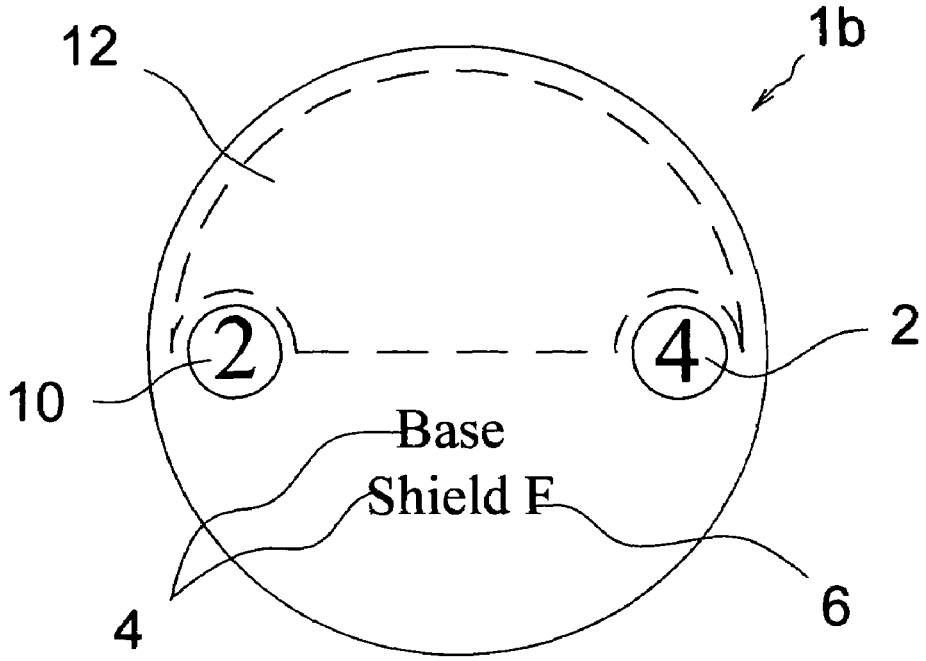
FIG. 1*b* depicts a "Base" game piece.
Figure 1C:
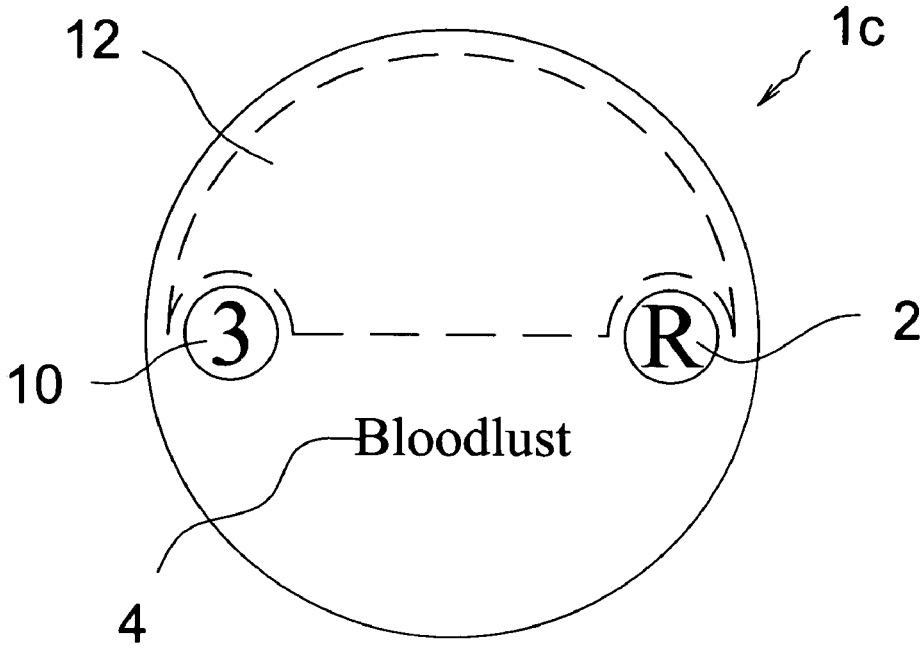
FIG. 1*c* shows a game piece embodiment having a "remove" indicia, "R," in lieu of a defense value.
Figure 1D:
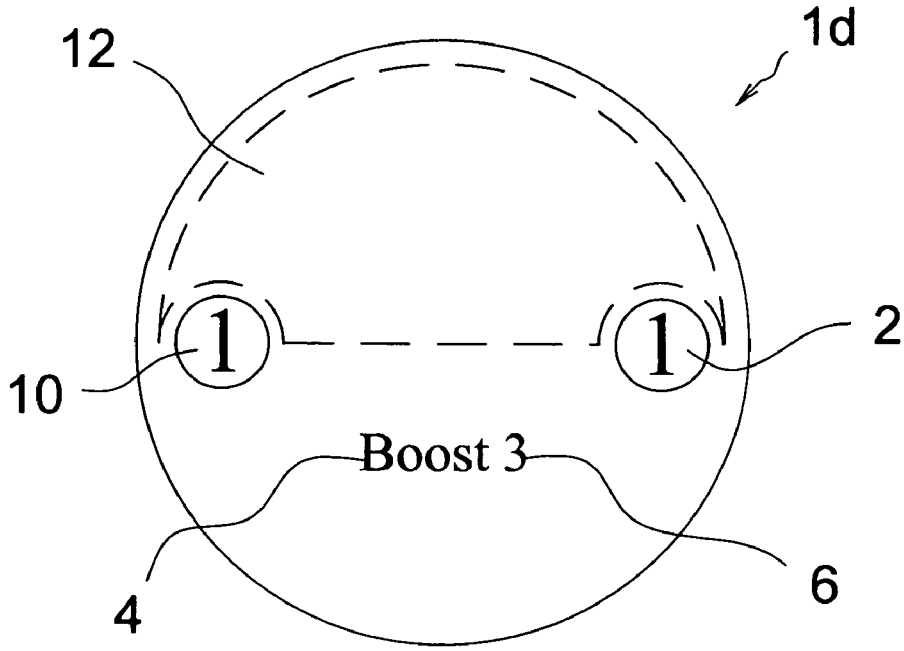
FIG. 1*d* depicts a "Boost" game piece having a capacity of three (3) and a defense value of (1).
Figure 1E:
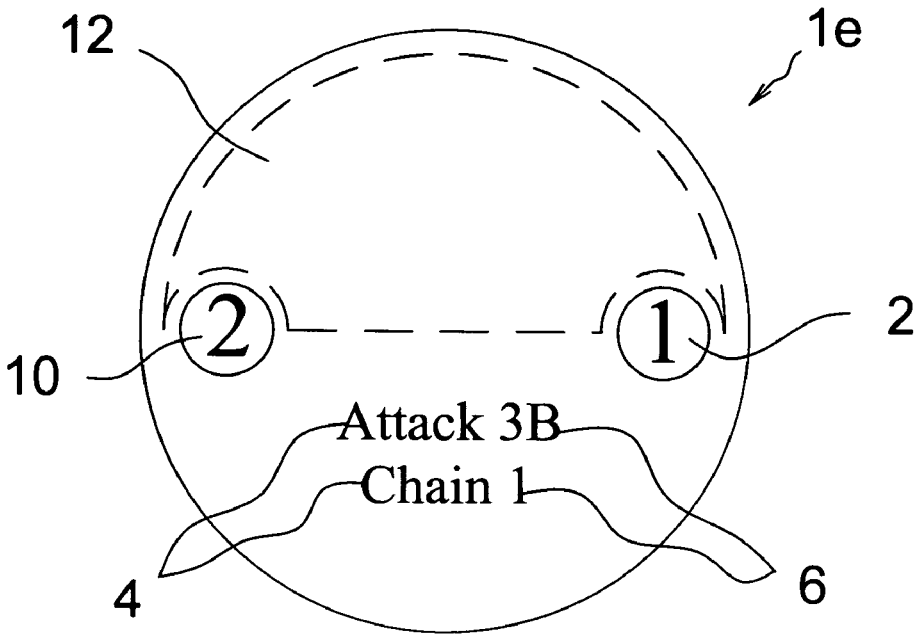
FIG. 1*e* shows a game piece having both a "Chain" characteristic indicia and an "Attack" characteristic indicia.
Figure 1F:
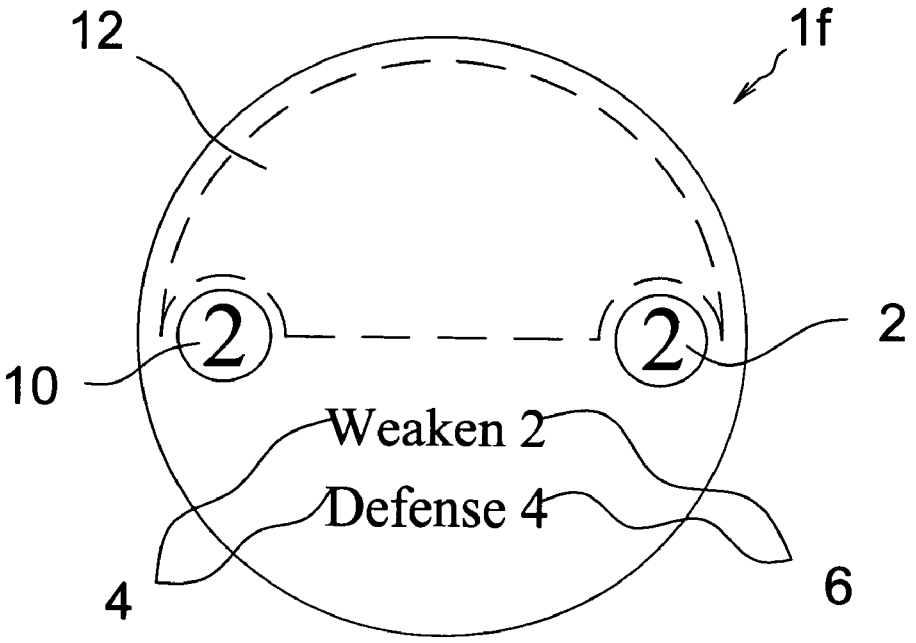
FIG. 1*f* shows a game piece having a "Weaken" characteristic and a "Defense" "characteristic," each with an associated capacity indicia.
Figure 1G:
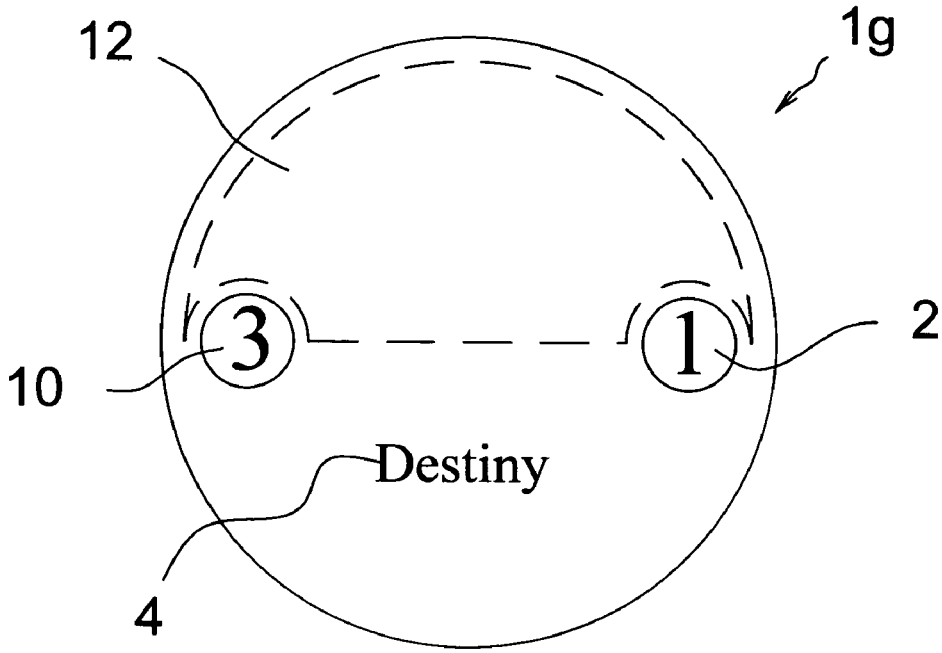
FIG. 1*g* shows a game piece having a "Destiny" characteristic.
Figure 1H:
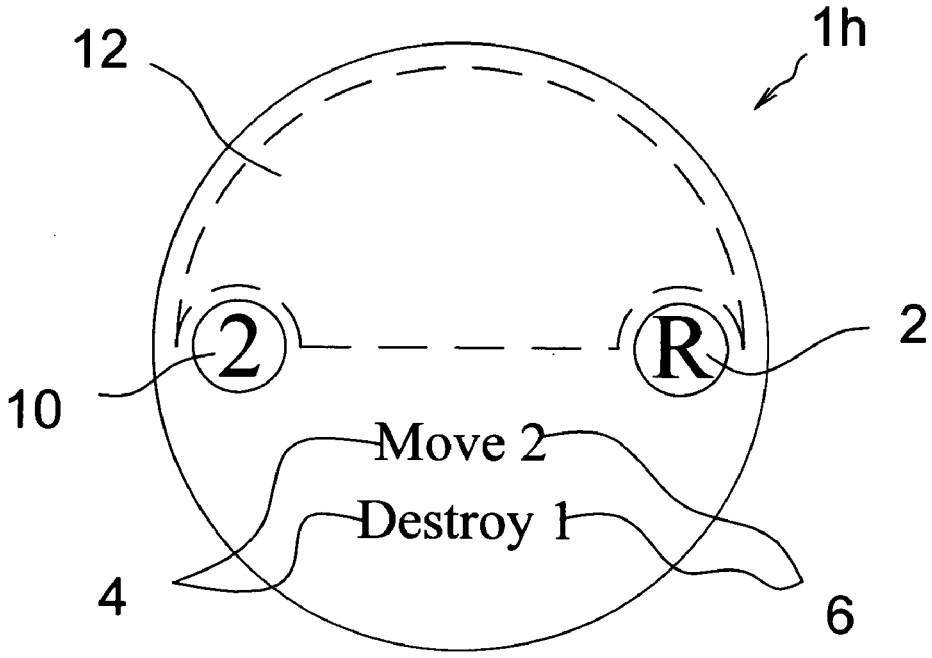
FIG. 1*h* shows a game piece have both a "Move" characteristic and a "Destroy" characteristic, each with an associated capacity indicia.
Figure 1I:
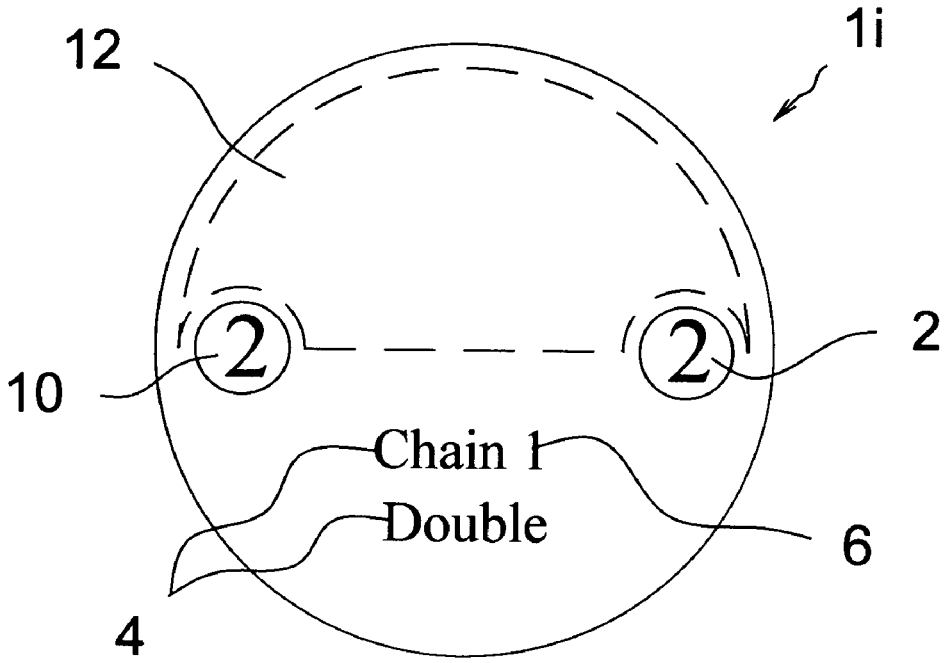
FIG. 1*i* shows a game piece having both a "Chain" characteristic and a "Double" characteristic, with the "chain" characteristic having an associated capacity indicia.
Figure 1J:
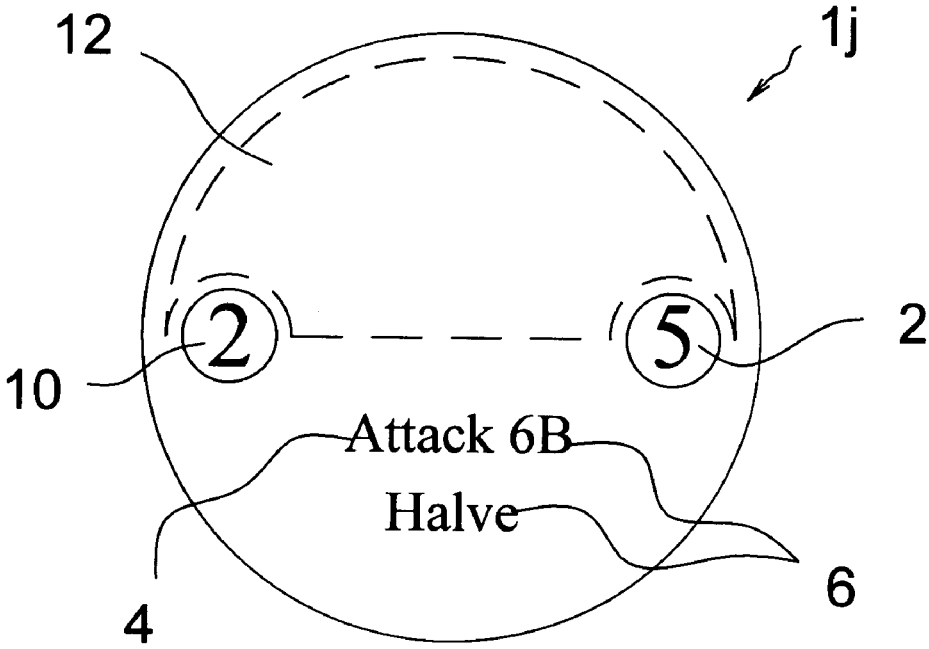
FIG. 1*j* depicts a game piece that comprises a "Halve" characteristic indicia.
Figure 1K:
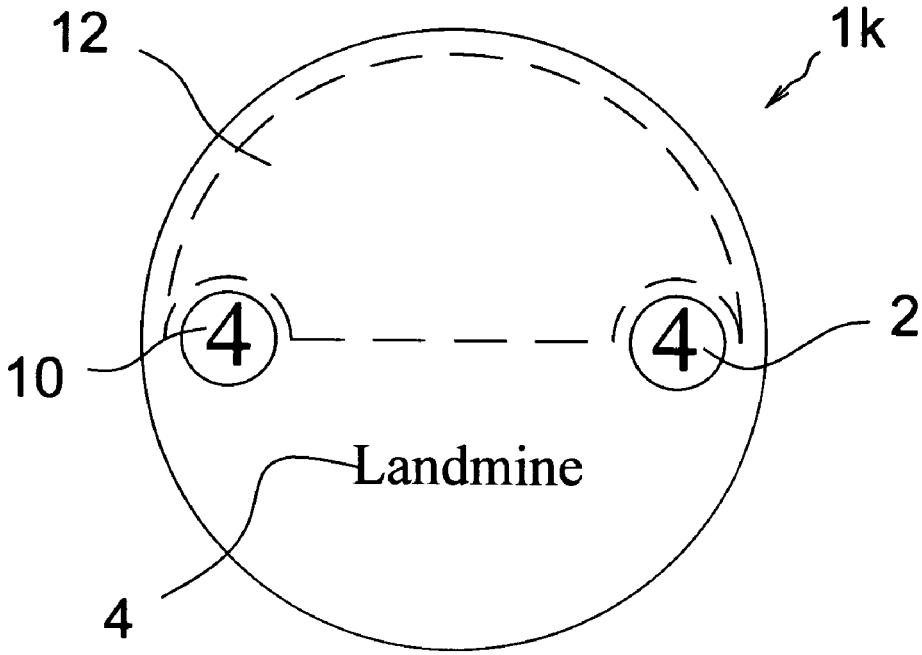
FIG. 1*k* illustrates a game piece having a "Destiny" characteristic.
Figure 1L:
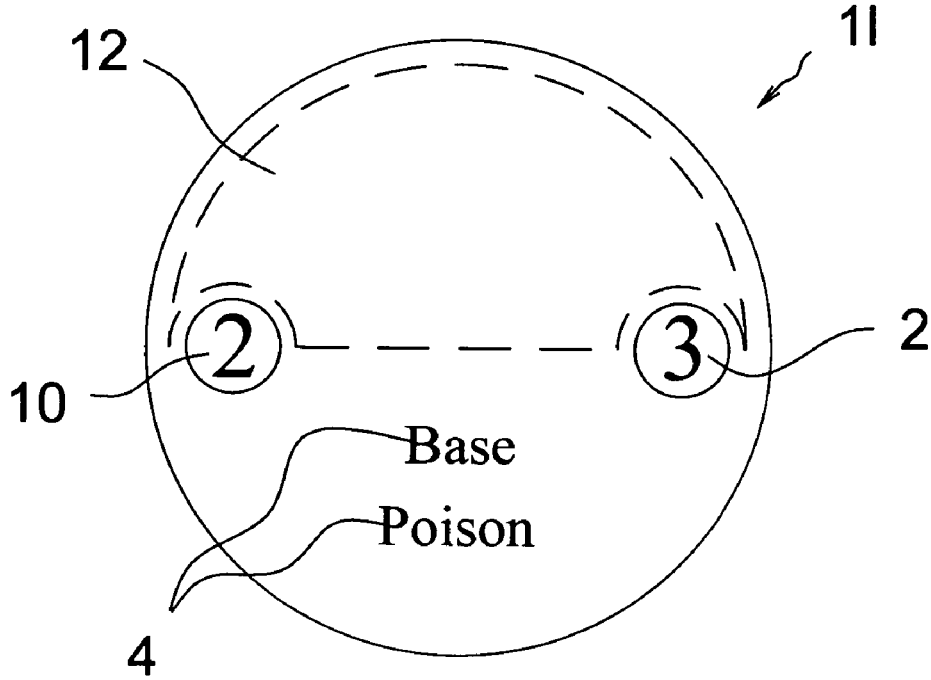
FIG. 1*l* shows a "Base" game piece having a "Poison" characteristic.
Figure 1M:
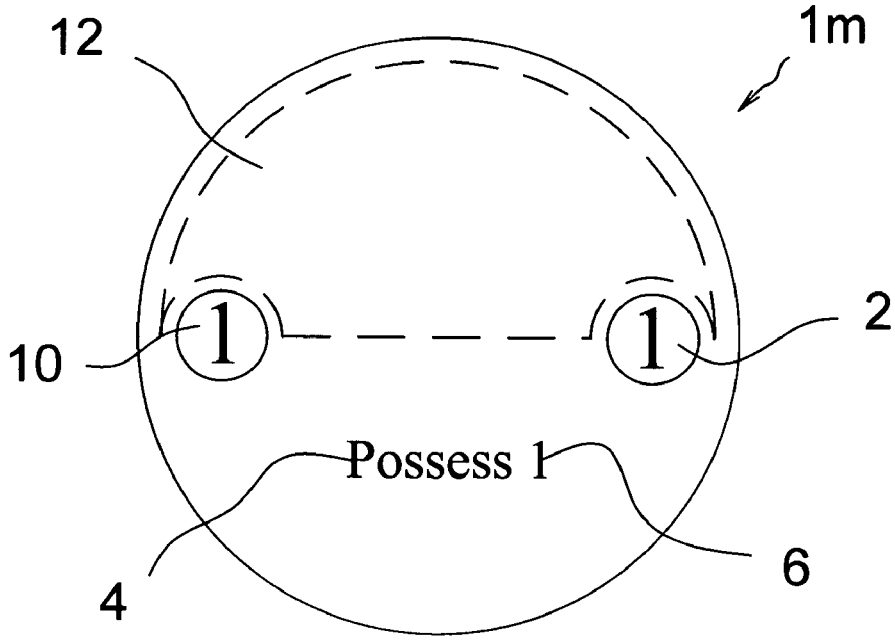
FIG. 1*m* shows a game piece having a "Possess" characteristic with an associated capacity indicia.
Figure 1N:
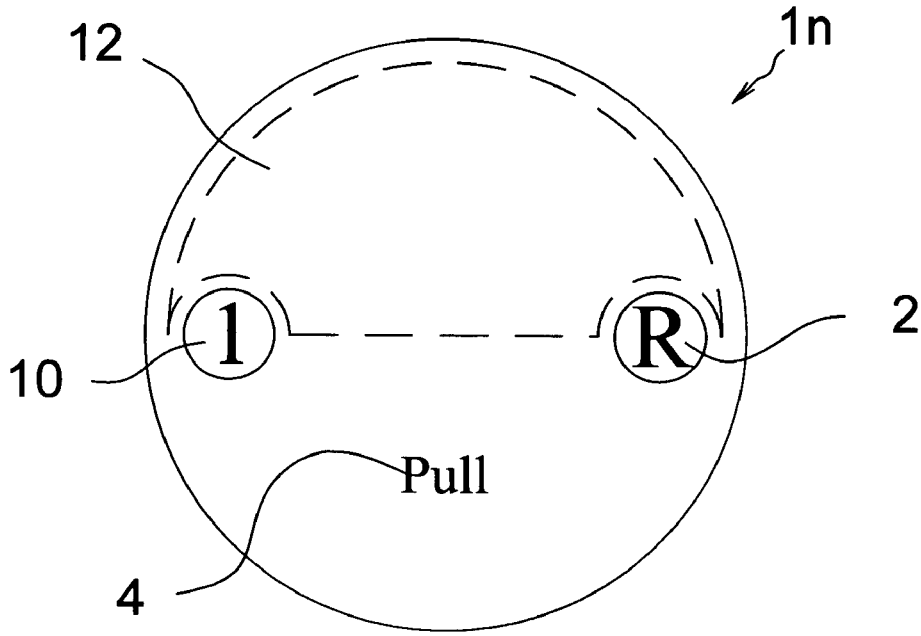
FIG. 1*n* shows a game piece having a "Pull" characteristic.
Figure 1O:
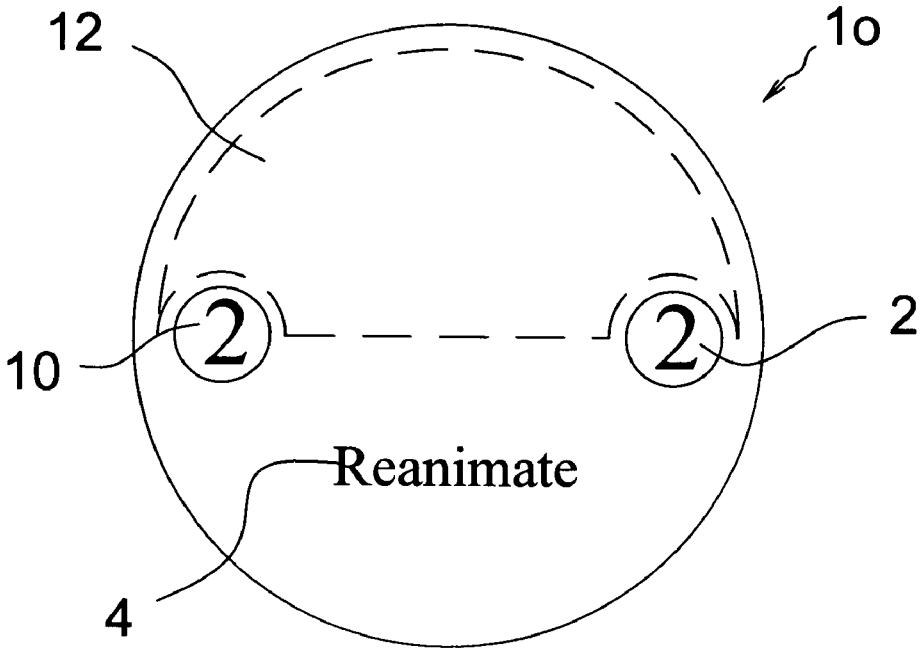
FIG. 1*o* shows a game piece having a "Reanimate" characteristic.
Figure 1P:
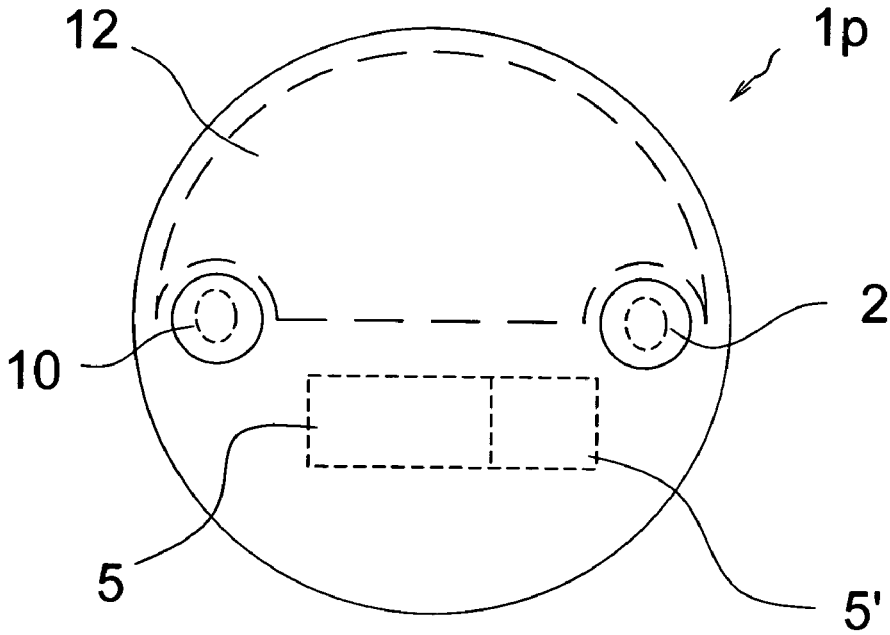
FIG. 1*p* shows a game piece with range indicia, point indicia, characteristic indicia field and capacity indicia field, all shown in dotted line, representing any of a myriad of possible combinations of indicia, as disclosed herein.
Figure 1Q:
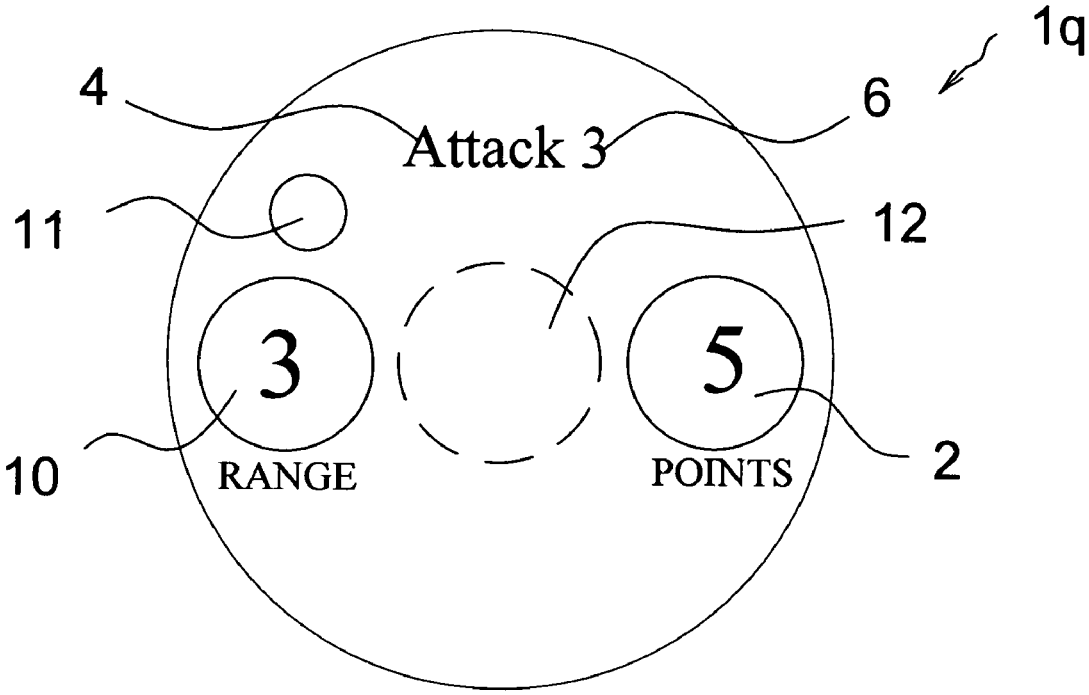

Also, in other embodiments, attachment members 11 can be provided, such as that illustrated in FIG. 1*q*. The attachment members 11 can be configured to be usable in identifying games pieces belonging to specific players in a particular game. In some embodiments, the game pieces have insertion cavities within which the attachment member 11 can be inserted to releasably lock the attachment member 11 to the game piece. As such, players may collect game pieces and couple their attachment members to the game pieces.

Figure 4:
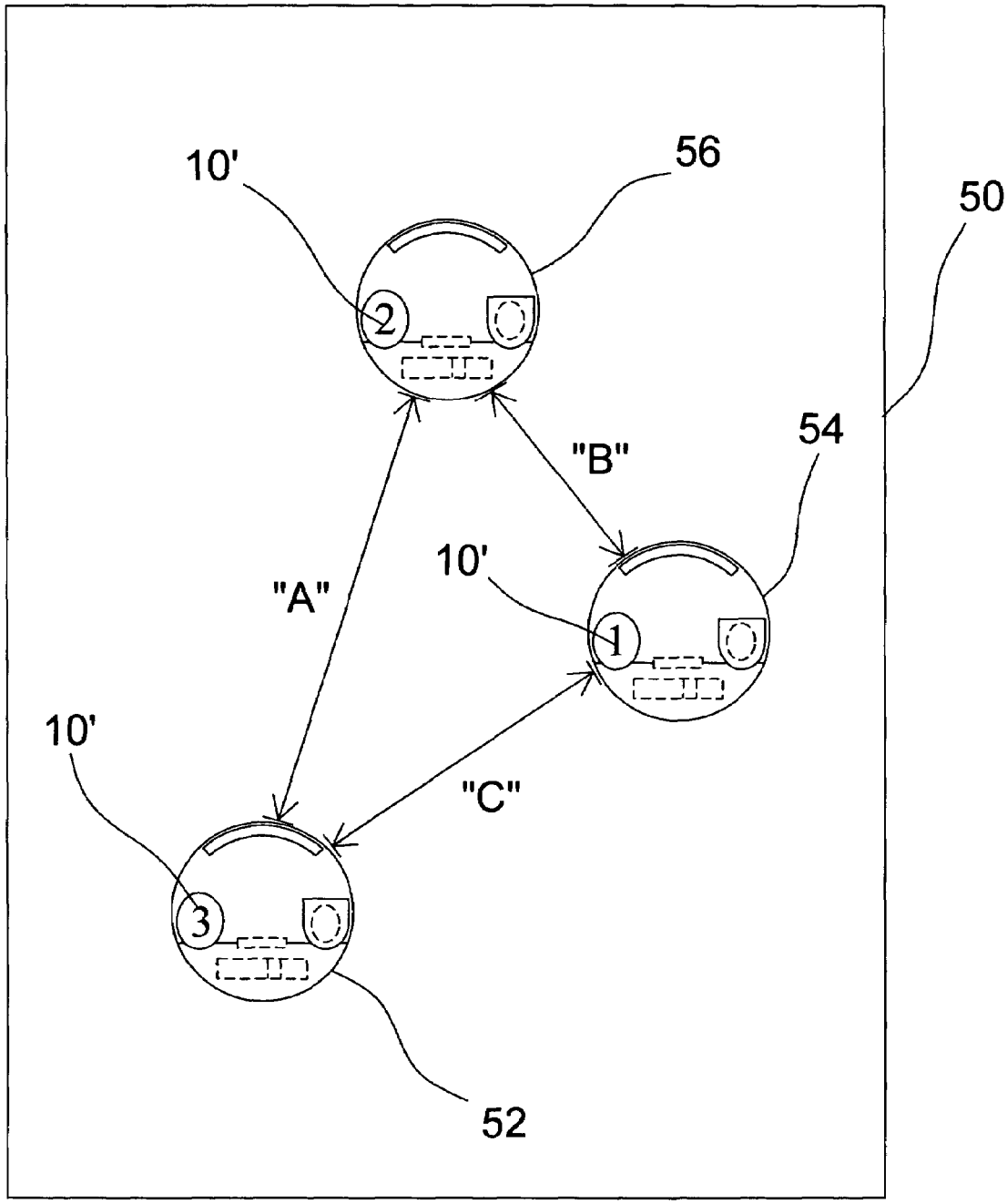
FIG. 4 is an overhead plan view showing an embodiment of the present invention utilizing game chips, such as those from FIG. 3*a*-3*i*, wherein the game chips have been deployed by players and rest on a playing surface, with dotted lines on the game pieces representing characteristic indicia, capacity indicia, point value indicia, defense value indicia, range indicia or fields in which such indicia can be illustrated on the game chips.

The game pieces 1*a*-1*q* can interact with one another during play, which can include affecting one another in a manner that results in actions taken by players to eliminate game pieces from play, moving game pieces on a playing surface, or adjusting or impacting point value accounting for the players. In addition, the game pieces 1*a*-1*q* can have ranges (or areas of effect) within which a particular game piece can affect another game piece. The range for a particular game piece can be indicated thereon by range indicia 10. Therefore, in some embodiments of the present invention, when a player deploys a game piece, such as those in FIGS. 1*a*-1*q*, onto a playing surface, the player determines whether the game piece has landed or come to a stop within a distance (specified by a range associated with the game piece) of another game piece before applying an interaction or effect between the game pieces. For example, without limitation, as shown in FIG. 4, three game pieces 52, 54, 56 rest on a playing surface 50 after a plurality of players have taken turns projecting their game pieces onto the playing surface 50 and applying various steps between each deployment (as discussed hereinafter). The game pieces rest within certain distances of one another represented by lines "A," "B" and "C." If, for example, game piece 56 was the most recently deployed game piece and the player that deployed game piece 56 wishes to have that game piece interact with, or affect game piece 54, that player can first determine whether the distance represented by line "B" is greater than, equal to, or less than the range indicia 10' on her or his game piece 56, which has a value of two (2) in the example in FIG. 4. Depending on other indicia of the game piece 56 (e.g., characteristic indicia 4, 4' and capacity indicia 6, 6' discussed further hereinafter), distance "B" may need to be equal to or less than the range two (2) on game piece 56, in order for the player to apply an effect of game piece 56 on game piece 54. This is an example embodiment of how range indicia 10, 10' can be used in some embodiments of the present invention, but is in no way exhaustive.

Figure 2:
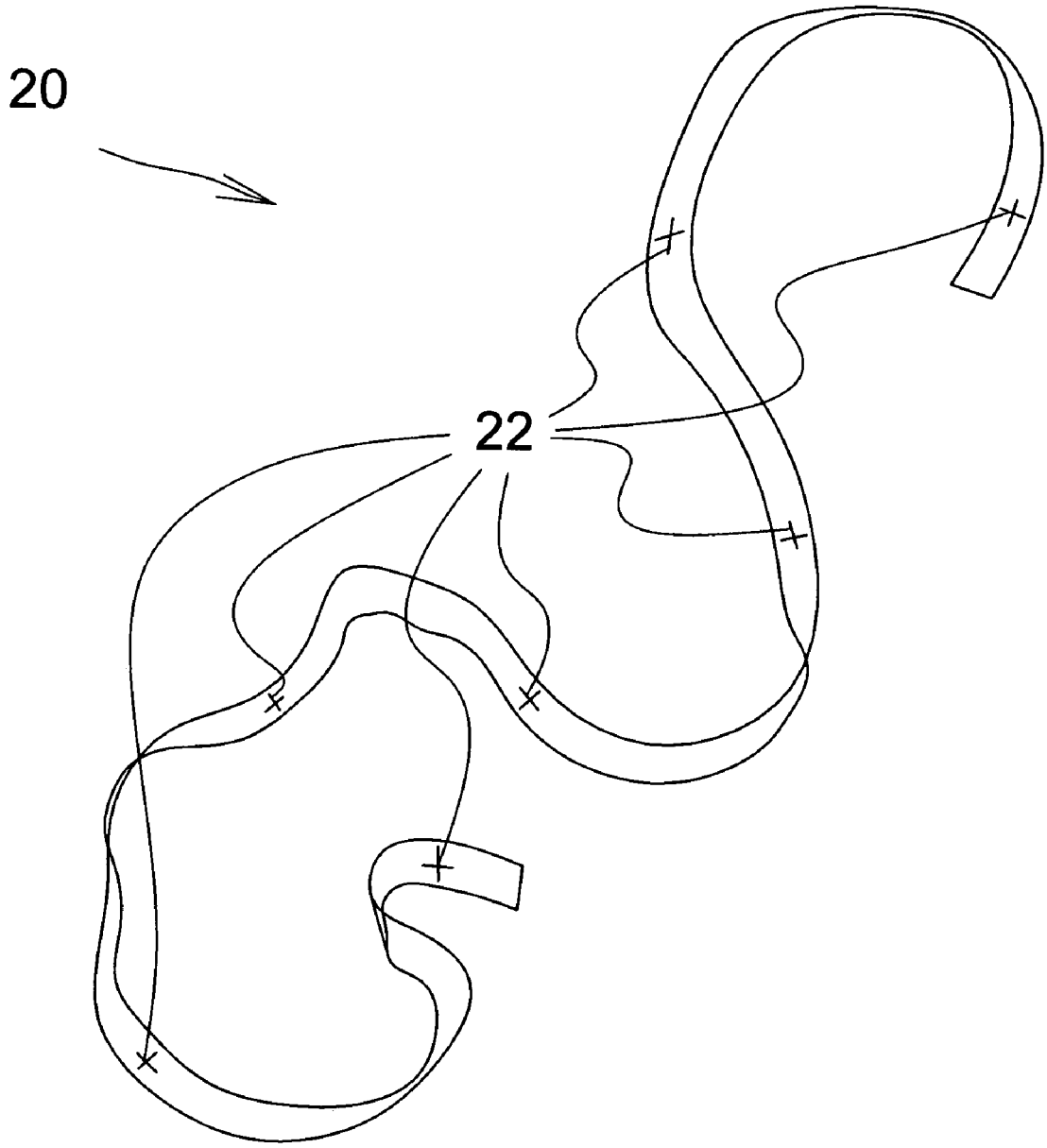
FIG. 2 is a perspective view of an embodiment of a measurement device for various embodiments of the present invention.

FIG. 2 illustrates an embodiment of a measurement device 20 that can be used to measure a distance between game pieces to determine whether a game piece is within the range of a potentially interacting game piece.

As will be appreciated by one skilled in the art after reviewing the present disclosure, the measurement device 20 can be made of any number of various materials, such as, for example, without limitation, fabrics or plastics. The measurement device may have a plurality of distance indicia 22 marked thereon that are spaced apart along a length of the measurement device 20 with equal distances therebetween. The range indicia 10, 10' of the game pieces can represent a required number of discrete increments, as defined by distance between distance indicia 22. A player may thus use the measurement device to determine if a game piece is within range of another game piece. Various measurement devices 20 may be selected for game play, having different actual distances between distance indicia 22. The selection of an appropriate measurement device 20 can be based, in part, on the area available for play—e.g., smaller distances between distance indicia 22 when the playable area is small and larger distances between distance indicia 22 when the playable area is larger. In other embodiments, the range indicia 10, 10' of the game pieces may be treated as representing one or more increments between the distance indicia, depending on player selection. For example, each range indicia value of one (1) may be treated as representing one or more distance increments on the measurement device, to adjust game difficulty. In other embodiments, players may use a playing surface marked with distance increments in two dimensions (not shown in the drawings), such as, for example, a playing surface having circles or squares of equal area marked thereon. In such embodiments the players may treat each marked area as equal to one or more range units. As will be appreciated by those skilled in the art after reviewing this disclosure, such markings may be treated during game play in various ways, provided that some consistency is implemented.

As can be seen in FIG. 1*p*, in some embodiments of the present invention, one or more of the game pieces have point indicia 2 thereon, indicating initial point values of the game pieces. These initial point values can be changed or eliminated by interaction with other game pieces during play. Point values can be used to determine player scores.

Each game piece can also have characteristics indicia 4, located in a characteristic indicia field 5, and capacity indicia 6, located in a capacity indicia field 5', as best seen in FIG. 1*p*, as well as FIGS. 1*a* through 1*o*. In some embodiments, characteristics indicia 4 identify certain non-quantitative characteristics of the game piece, namely, how a game piece interacts with other game pieces, including how it affects other game pieces or is affected by other games pieces, or how it interacts with a physical field of play (e.g. whether it is to be thrown or selectively placed on the playing surface, traded with other pieces, or used to swap out other game pieces). Characteristics indicia 4 can also provide information about how a game piece modifies or resists the effects of another game piece (i.e., how the game piece interacts with the characteristics of another game piece). A game piece may have one or more characteristics indicia 4, or companion characteristics.

In some embodiments, capacity indicia 6 are provided, and can be quantitative, in contrast with the qualitative characteristic indicia 4. The capacity indicia 6 can modify or define the extent of the characteristics of a game piece and can typically be numbers, letters, symbols or a combination thereof. On a given game piece with multiple characteristic indicia 4, a capacity indicia 6 can be positioned proximate the characteristic indicia 4 that it modifies. For example, in the game piece embodiment of FIG. 1*a*, the capacity indicia 6 is "3B" and defines the extent, or capacity of the characteristics indicia 4, "Attack," shown on the game piece. Further examples will be illustrated below.

In some embodiments of the present game invention, players execute the following steps (in overview):

1) Each player selects a playing-group (or playing-stack) of game pieces to play the game. The playing-group can be selected from a player's collection of game pieces, which may be acquired through purchase or trading with other players. In some embodiments, the selected playing-group must consist of fifteen (15) pieces with a sum total of all points (as indicated by the point indicia 6 on each piece), totaling 25 points. In other embodiments, the playing-group can comprise greater or less than 15 game pieces and can total greater or less than 25 points. In other embodiments, different requirements or conditions can be set for the total number of points or total number of playing pieces for the playing-group.

In addition, there may be restrictions imposed on the number of game pieces having certain characteristics that can or must comprise the playing-group. For example, in some embodiments of the present invention, certain game pieces have "Base" characteristics indicia and two Base pieces, no more and no less, must comprise the playing group.

2) The players determine a deployment order. Various methods can be employed to determine a deployment order. In some embodiments, the players may blind draw game pieces, and take turns according to the point value of the pieces drawn by the players.

3) Each player deploys a Base game piece in the turn order determined during step 2 above. Deployment can comprise projecting the Base piece onto a surface of play, such as a floor, table or desk or other structure having a surface area.

4) Each player then deploys the remainder of her or his game pieces in the turn order. Deployment can comprise strategic considerations related to characteristic indicia, capacity indicia, point value indicia, and range indicia of the game pieces (and defense value indicia in other embodiments) and dexterity in projecting the game piece within range or out of range of game pieces already deployed.

5) After all game pieces have been deployed, the total points for each player is determined. This can be done by totaling point values for each player based on her or his deployed game pieces. This accounting of points can take into consideration game pieces that have been eliminated from play by interaction, thereby reducing the point values to zero for such game pieces, and point values that have been modified from the initial point values for the game pieces, also by interaction with other game pieces during play.

6) The player with the highest total of point values (i.e., the highest score) is the victorious player in some embodiments.

During each deployment turn, players can pause before deploying their game piece to contemplate deployment strategy based on the indicia 2, 4, 6, 10 of the game pieces. After a player deploys any particular game piece during a turn, determinations can be made as to whether the deploying player can, must or chooses to apply a characteristic (i.e., allowing her or his game piece to interact with one or more other game pieces) of the deployed game piece, as can be determined or defined within an associated rule set, as will be appreciated by those skilled in the art after reviewing this disclosure. That is, for example, depending on the characteristic of a game piece deployed, a player may:

(a) select to act upon or apply the piece's characteristic immediately after its deployment;

(b) be required to act upon or apply a characteristic of the game piece immediately after the piece's deployment; or (c) be required to wait for a triggering event (such as another piece being deployed within its range) before a characteristic of the deployed piece can be applied or acted upon.

Some characteristics can be selectively applied after deployment while others cannot. For some embodiments of the present invention, an example of situation (a) above is when the game piece deployed has an "Attack" characteristic. Attack pieces may be defined in an associated rule set as having the ability to eliminate certain ones of the opponent's game pieces. An "Attack" characteristic can be applied selectively by a player immediately after deployment, in the same turn. On the other hand, in other embodiments, the "Attack" can be saved for attacking an opponent's piece later in case an opponent deploys a game piece within range of the Attack piece. An example of situation (b) above is when the game piece deployed has a "Destroy" characteristic. A Destroy piece can be defined within an associated rule set as having the ability to eliminate the closest piece within range of the Destroy piece. That characteristic can also be defined to be automatically applied without choice by the player and upon deployment. That is, the player cannot choose when the "destruction" occurs. Also, an example illustrative of situation (c) above is when a game piece with a "Landmine" characteristic is deployed. The Landmine characteristic can eliminate any piece within its range; however, it cannot be applied or acted upon by a player after deployment. It is dormant upon deployment and affects other game pieces only when triggered by an event, such as another game piece being deployed within range of the landmine piece. Moreover, in some embodiments, a player is unable to apply the characteristics of a deployed game piece because it is eliminated immediately after deployment by interaction with an opponent's game piece or otherwise inhibited by interaction with an opponent's game piece. These are just some examples of the application of characteristics. A more extensive (but not exhaustive) description of some characteristics 4 and capacities 6 for various game pieces of the present invention is now described.

As noted, in various embodiments of the present game, one or more rule sets can be provided that can be used to cross-reference the characteristics indicia 4 or capacity indicia 6 on game pieces, the rule set explaining how each different characteristic is used or applied. The rule set can be provided to players upon purchasing an embodiment of the game invention. The rule set can also be cross referenced to determine how a particular capacity limits or enhances a characteristic, as will be understood by one skilled in the art after reviewing the present disclosure including the examples below.

The following examples illustrate some game piece embodiments of the invention and methods of playing the same. However, one skilled in the art will appreciate upon reviewing this disclosure that other possible combinations and variations of the characteristics, capacities, ranges, and point values for the game pieces abound.

FIG. 1*a* illustrates an "Attack" piece that is also a "Shield" piece. Therefore, the game piece 1*a* has two characteristics, "attack" and "shield," as indicated by the characteristics indicia 4. In other embodiments, the game piece may have only one characteristic indicia 4. In some embodiments, after a player deploys an attack piece, it can be applied to affect an opponent's game piece unless otherwise inhibited.

"Attacking" a game piece can comprise (a) determining if the attacking piece is within range of an attacked or targeted game piece, which can be determined by referring to the range indicia 10 of the attacking piece and using the measurement device 20 (or other measurement device or surface as described above), to measure the range between the game pieces; and if so, (b) determining whether the attacked or targeted piece has a point value—as indicated by point indicia 2—that is less than or equal to the attack capacity indicia 6 of the attacking piece (in other embodiments, defense indicia 36 are compared with attack capacity, rather than point value 2, as further discussed hereinafter); and if so (c) removing or eliminating the attacked game piece from play, thereby eliminating the point value of the attacked game piece.

Conditions (a) and (b) must be satisfied before a successful "attack" is accomplished that results in elimination of the targeted game piece from play. For example, in the embodiment illustrated in FIG. 1*a,* the game piece 1*a* can only attack game pieces that are within a range of three (3), as indicated by the range indicia 10, and have a point value of three (3) or less, as indicated by the attack capacity indicia 6, showing a value of "3." In addition, it is noted that in some embodiments of the present invention, some game pieces are immune to attack unless otherwise signified by the attack capacity indicia 6 of a particular attack piece. That is, the capacity indicia 6 can signify whether an attack piece has enhanced attack capacities that allow it to attack the otherwise immune game piece. For example, in some embodiments, game pieces having "Base" characteristics are immune to attack, such as the game piece shown in FIG. 1*b.* However, the letter "B" in the attack capacity indicia 6 can indicate an enhancement capacity that overcomes the immunity of the base piece. For example, the game piece 1*a* has a letter "B" in the attack capacity indicia 6, allowing it to attack a base piece.

A "Shield" piece, as indicated by characteristics indicia 4 illustrated in FIG. 1*a,* has the ability of shielding a piece from an "attack." Shielding a game piece comprises determining if the shield piece is within range of targeted game piece for which shielding is desired. If the targeted game piece (i.e., the piece which the player desires to shield) is within range, the targeted piece will be immune to an attack from an attack piece. In some embodiments, the player must declare, or otherwise designate the targeted piece immediately after deploying the shield piece. In other embodiments, the shield piece may have enhanced capacities, indicated by capacity indicia 6, such as that shown in FIG. 1*b.* The game piece in FIG. 1*b* has an enhanced shield capacity indicated by the letter "F" which can allow the shield piece to shield an unlimited number of the deploying player's game pieces within range of the shield piece.

FIG. 1*b* illustrates a "Base" piece that is also a "Shield" piece, as signified by its characteristic indicia 4. In some embodiments of the present invention, base pieces can have the highest point values among game pieces, as indicated by the point indicia 2. The base pieces can also be immune to certain interaction characteristics of other game pieces, such as attacks, unless the certain characteristics of the other game pieces are enhanced.

FIG. 1*c* illustrates an embodiment of a "Bloodlust" piece. A bloodlust characteristic allows all game pieces within range of a particular bloodlust piece to attack. For example, in some embodiments, after an attack piece has attacked, it cannot be used to attack again unless permitted to do so by interaction with one or more other game pieces having characteristics capable of renewing an attack for a game piece. A bloodlust piece has a characteristic that allows an attack piece within its range to execute a new attack. This effect can be imparted to the deploying player's game pieces as well as opponent game pieces within range of the bloodlust piece.

FIG. 1*d* illustrates an embodiment of a "Boost" piece. A boost piece can "boost" an attack capacity of an attack piece or a defense capacity of a "Defense" piece. In some embodiments, the boost piece boosts all attack pieces or defense pieces within range of the boost piece. Boosting a game piece can comprise (a) determining if the targeted game piece is within range of the boost piece; and if so (b) adding a value of the boost capacity, as indicated by capacity indicia 6, to the attack or defense capacity of the targeted piece. For example, if the boost piece 1*d* is deployed within range of the attack piece 1*a* in FIG. 1*a,* then the boost piece 1*d* can add three (3) capacity units—since the illustrated boost piece has a capacity indicia with a value of "3"—to the attack piece 1*a.* After being boosted, the attack piece 1*a* would have an attack capacity of "6B." In some embodiments, the boost piece boosts all attack or defense pieces within range of the boost piece.

A "Chain" piece, such as that illustrated in FIG. 1*e,* can extend its range by chaining ranges from a player's deployed pieces, or friendly pieces, together. The chain capacity indicia 6 with a value of "1" in the illustrated game piece 1*e* signifies the number of range values from friendly pieces that can be chained together to extend the range of the chain piece. For example, if the illustrated chain piece 1*e* is deployed within a range of two (2)—as indicated by the range indicia 10 of a targeted piece, then the range of one targeted piece can be added to the range of the chain piece to determine a total chained range of the chain piece. In some embodiments, a player could then apply another companion characteristic of the chain piece against an opponent's game piece within the chained range. For example, in the illustrated embodiment of FIG. 1*e,* the "attack" characteristic of the game piece 1*e* could be applied to attack a target piece within the chained range.

In some alternative embodiments of the present invention, "Defense" pieces are provided, such as that illustrated in FIG. 1*f.* The capacity of the defense piece is signified by capacity indicia 6. The defense piece may "defend" against attacking pieces under the following conditions: (a) the attacking piece is within a range of the defense piece; and either (b) the capacity of the defense piece is greater than the capacity of the attacking piece or (c) the capacity of the defense piece is equal to the capacity of the attacking piece. If conditions (a) and (b) above are satisfied then the attacking piece is eliminated from play. If only conditions (a) and (c) above are satisfied, then both the defense piece and the attacking piece are eliminated from play.

In other embodiments, if an attacking piece has a greater attack capacity than the defense capacity of a defense piece then the defense piece is eliminated from play.

In further embodiments of the present invention, various defense pieces may present a group "defense" against an attacking piece. In such embodiments, all defense pieces of a player within range of an attacking piece may add their defense capacities together to defend against the attacking piece. If the sum total of the defense capacities is greater than the attack capacity of the attacking piece, then the attacking piece is eliminated. If the sum total of the defense capacities of the defending pieces is equal to the attack capacity, then all pieces are eliminated, including the attacking piece and all defense pieces within the group.

Another embodiment of a game piece for the present invention has a "Destiny" characteristic, as illustrated in FIG. 1*g*. Destiny pieces may be deployed to require all players to take turns deploying game pieces within range of the destiny piece, according to a range associated with the destiny piece. For example, if the destiny piece of FIG. 1*g* is deployed by a player, all other players may be required to deploy pieces that come within a range of three (3) of the destiny piece on their next turns. If the pieces deployed do not fall within the range of the destiny piece, they are eliminated.

FIG. 1*h* shows an embodiment of a game piece having a "Destroy" characteristic. A destroy piece can eliminate any piece within its range after being deployed, up to the number of pieces indicated by its corresponding capacity indicia 6. For example, destroy piece 1*h* has a destroy capacity indicia of one (1). The destroy piece can therefore eliminate one game piece within its range, without regard to the point value of the targeted game piece being "destroyed." In some embodiments, the destroy piece is not selective and will destroy opponents as well as friendly game pieces, in order, from the closest game piece to the farthest game piece, until the capacity of the destroy piece is exhausted or otherwise depleted. The destroy characteristic of a destroy piece can only be applied during a player's turn in deploying that piece.

Further embodiments of the game pieces comprise a "Double" interaction characteristic. Game pieces having a "double" characteristic, such at that illustrated in FIG. 1*i*, can affect other game pieces by doubling the point value of all game pieces within range of the double piece. Any game piece within range of two or more double pieces can be affected by each of those double pieces in multiplicative series. That is, each of the point values indicated by the point indicia 2 of the game pieces within range can be multiplied by two (2) as many times as there are double pieces for which the game piece is in range.

In other embodiments of the game pieces, the interaction characteristics include "Halves." Halve pieces, such as that illustrated in FIG. 1*j*, work in an opposite manner as double pieces. That is, halve pieces can divide the point value of a game piece by two (2). In some embodiments, if the point value of a game piece is divided below a value of one (1), then the game piece is eliminated from play.

"Landmine" pieces, such as that illustrated in FIG. 1*k*, are dormant once deployed. However, if another game piece is deployed within range of the landmine piece, the landmine piece eliminates the other game piece. It is noted that in some embodiments without landmine capacity indicia, the landmine piece is not restricted from eliminating any piece that is deployed within its range, regardless of the indicia 2, 4, 6, 10 of the eliminated piece.

"Move" pieces, such as that shown in FIG. 1*h*, may be selectively "moved" or displaced in any direction on a playing surface immediately after being deployed. They may be moved by as many units as is indicated by the capacity indicia 6 corresponding to the "move" characteristic. For example, the move piece 1*h*, shown in FIG. 1*h*, can be moved two (2) units as indicated by the "move" capacity indicia 6, in any direction on the playing surface, immediately after being deployed by a user. Piece 1*h* has a companion "Destroy" characteristic. The "destroy" characteristic may be used by the player to "destroy" an opponent's game piece within range after the move piece is moved. If the move piece had a different companion characteristic, as is contemplated for other embodiments of the present invention, the different companion characteristic could also be applied by a player after the movement was complete.

In other embodiments, some move pieces can permit other pieces to be "moved." For example, if the capacity indicia 6 of a move piece indicates the letters "O," "F," or "A," the move piece can affect another piece in range of the move piece. In other embodiments, the letters are replaced by symbols or combination of letters with symbols, as will be appreciated by those skilled in the art after reviewing this disclosure. The letters can stand for, "opponent" game piece, "friendly" game piece and "all" game pieces, thereby indicating which game pieces can be moved.

In other embodiments of the present invention, a "Poison" piece 11 is provided, as shown in FIG. 11. The poison piece can eliminate all pieces within range of the poison piece. Poison pieces can differ from destroy pieces in that their characteristic can remain active throughout a game rather than being applied only during the round in which they are deployed.

"Possess" pieces can also be provided, such as that shown in FIG. 1*m*. A possess piece can "possess" an opponent's game piece within its range. This can be physically represented during game play by placing a player's possess piece atop an opponent's game piece. When a piece is "possessed" the possessing player acquires that piece's characteristics, capacities, point value and range, unless and until the possess piece is eliminated or destroyed.

A "Pull" piece, such as that illustrated in FIG. In, can cause any other piece within its range to be "pulled" towards the pull piece, once the pull piece is deployed. That is, players may be required to physically move all pieces within the pull piece's range, opponent and friendly pieces, toward the pull piece until they are touching the pull piece. This can have the effect of causing certain other game pieces to interact based on their characteristics indicia 4 and capacity indicia 6. For example, if an attack piece was deployed out of range from a desired targeted piece, and the deploying player did not therefore spend the "attack," a pull piece could be deployed within range of the attack piece to pull the attack piece to within range of the targeted piece.

Some game pieces can have "Reanimating" characteristics, such as that illustrated in FIG. 1*o*. A reanimate piece may be used to "reanimate" a player's game piece that has already been eliminated from play. This can comprise requiring that the reanimate piece be deployed within range of a friendly piece, and if so, allowing the deploying player to re-deploy a previously eliminated friendly game piece of the player's choice. The reanimate piece will thereafter have no other interaction characteristics and be removed from play.

Further embodiments of the present invention described hereinafter are illustrated in FIGS. 3*a*-3*i*. Game components in these embodiments can comprise game pieces that are circular chips, or poker-style game chips, like game chips 3*a*-3*i*, and can be between 1.25 inches to 2 inches in diameter. In some embodiments, the game chips are about 1.57 inches or 1.5 inches in diameter. In other embodiments, the game chips have a diameter greater than 2 inches or less than 1.25 inches.

In these embodiments, players may select playing stacks of a fixed number of chips, such as, for example, fifteen chips. In other embodiments, the playing stack may comprise more or less than fifteen chips. In these embodiments, the chips can represent troops, bases, actions, and relics from a faction. Also, in some embodiments, players may play from a common stack, sharing game chips, rather than having their own playing stack.

A plurality of the chips have assigned names that appear on a name field 32' of the chips (names are not shown in the Figures). Also, point values can be assigned to a plurality of the chips within a point indicia field 34'. In some embodiments, the point values are indicated by circular indicia or dots 34 that show both a cost to put the chip into a playing stack (that is, the player may allotted a certain number of points in her playing stack, such as, for example, twenty five (25) points total) and a number of points the chip is worth if it is on the playing area or playing surface at the end of game play.

Figure 3A:
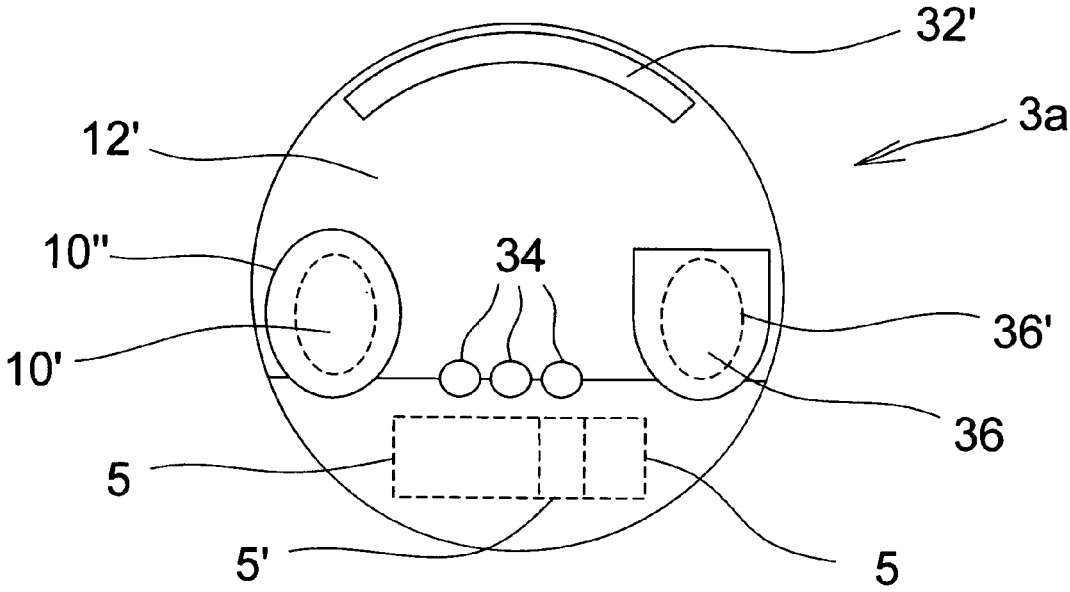
FIGS. 3*a* through 3*i* are overhead plan views of additional embodiments of game components usable with various embodiments of the present invention, wherein the game components are game chips.
Figure 3B:
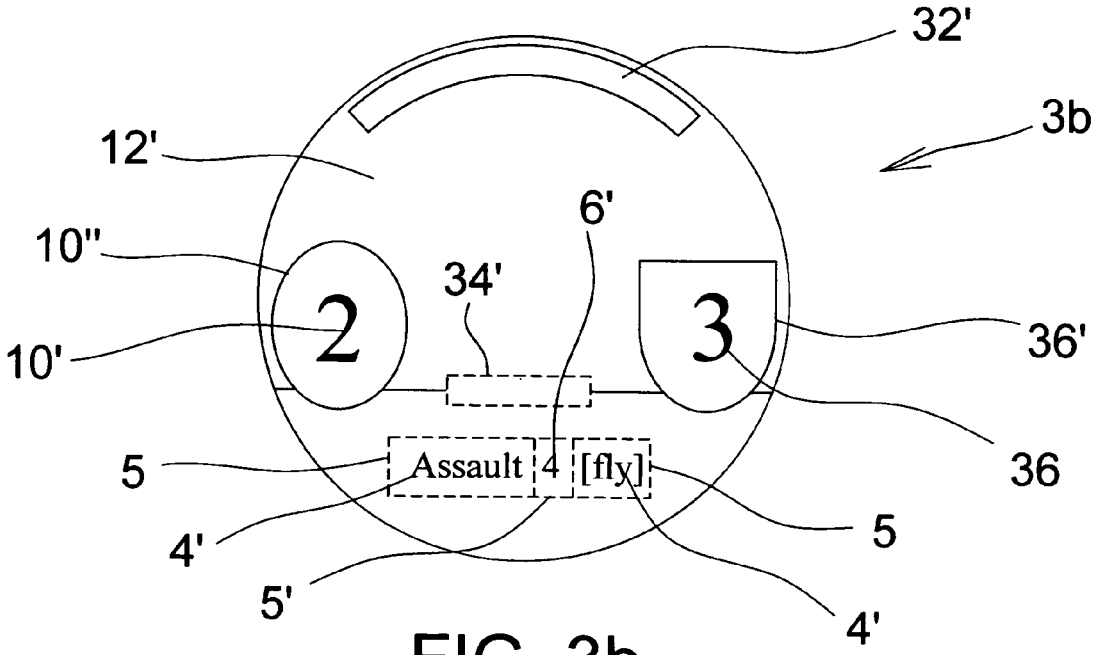
Figure 3C:
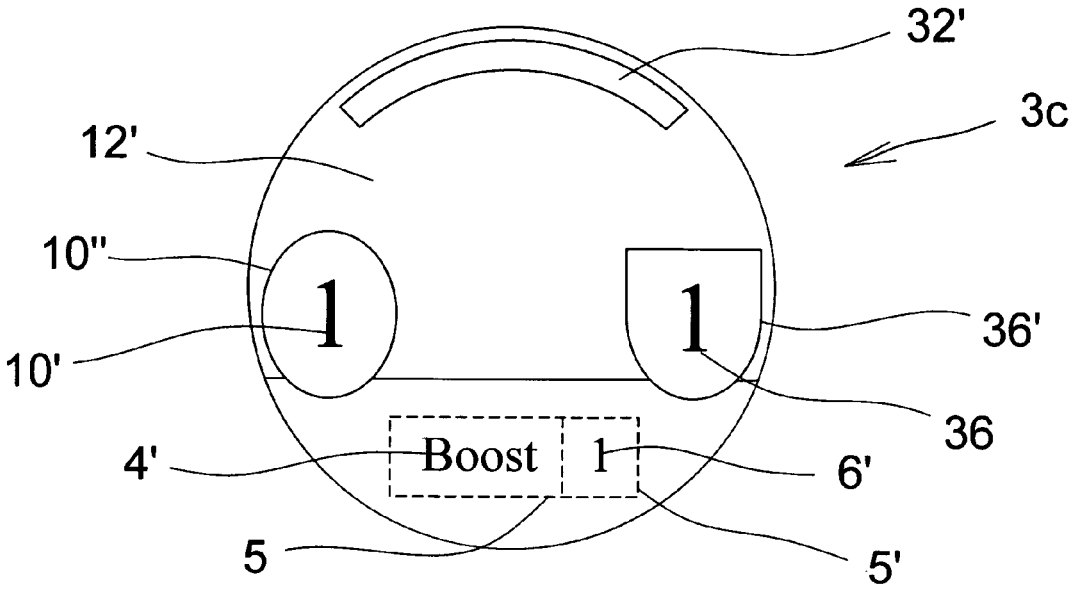

Also, various chips can have range indicia 10' within a range indicia field 10" on the chip, such as that illustrated in FIG. 3*b*. In some embodiments, players may treat the actual distances that the range indicia 10' represent to be two inches per unitless value of the range indicia. In other embodiments, the range indicia 10' can represent larger or smaller distance increments. Actual distance that range indicia represent may be treated as, or adjusted by, two (2) inches per range value for every three feet of diameter of a given playing area. Referring to FIG. 3*b*, in this example, if the diameter of the playing area is three feet, the actual distance represented by the range indicia 10' in FIG. 3*b* is four (4) inches (e.g., 3 feet×2 inches/3 feet×unitless range value of 2), whereas if the diameter of the playing area is six feet, the actual distance represented by the range indicia 10' in FIG. 3*b* is eight (8) inches (e.g., 6 feet×2 inches/3 feet×unitless range value of 2).

In some embodiments, the chips have defense indicia (defense values or numbers) 36 illustrated in a defense indicia field 36', such as that in game chip 3*b*, in FIG. 3*b*. This can be contrasted with some previously disclosed embodiments, such as that in FIG. 1*p*, where point value indicia 2 was used as a defense value in that the point values are indicated in field 34' for the embodiments of FIGS. 3*a*-3*i*. The defense number 36 can determine a chip's ability to resist attacks from other chips. (In such embodiments, "Action" chips, as described below, can lack a defense value and have an "R" printed on the game chip in lieu of the defense number 36 or indicia. The "R" may serve as a reminder for players to remove an action chip at the end of a player's turn.)

Figure 3D:
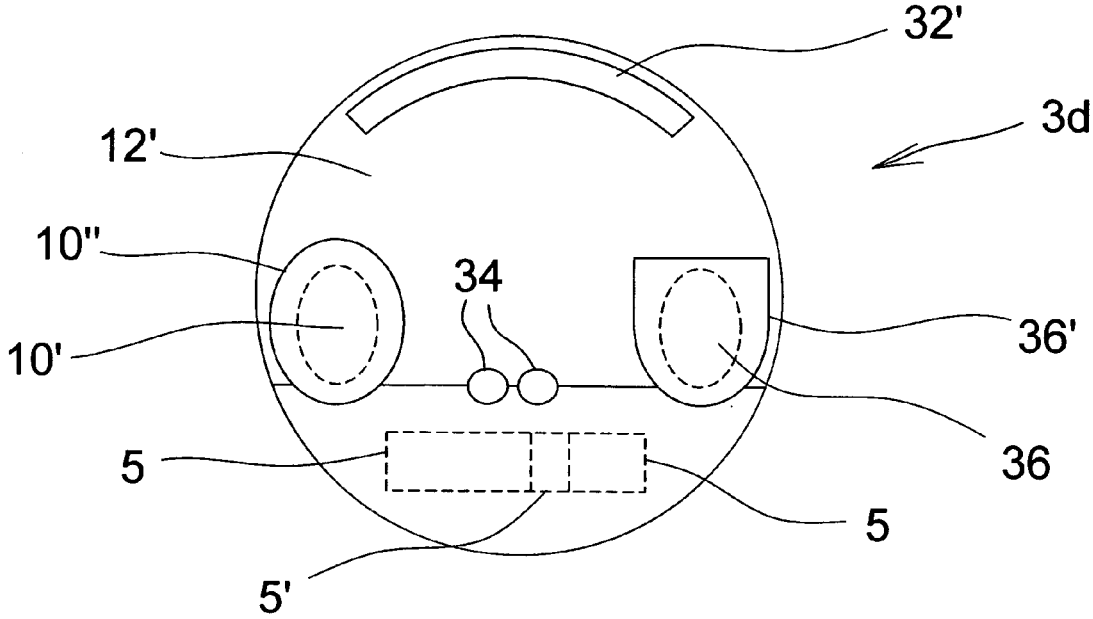
Figure 3E:
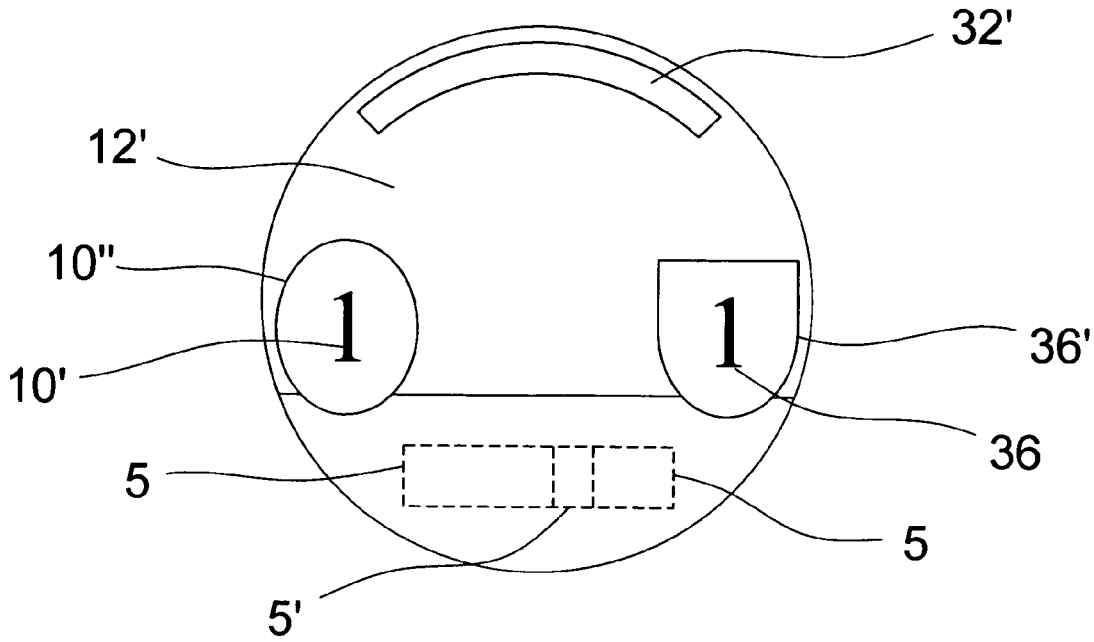

Game chips, such as those illustrated in FIGS. 3*a*-3*i*, can also have characteristics indicia 4' and capacity indicia 6' within fields 5, 5', such as shown in FIG. 3*b* & FIG. 3*d*. As will be appreciated by those skilled in the art after reviewing this disclosure, a myriad of combinations of characteristic indicia 4' and capacity indicia 6' representing various characteristics and capacities can be provided for the game chips, including some game chips that may lack one or more of these indicia. Game chips 3*a*-3*i* illustrated in FIGS. 3*a*-3*i* are only provided as examples and are in no way an exhaustive illustration.

The characteristic indicia 4' can include words that represent a game chip's "abilities," "immunities," or "ignorable abilities." The game chip's abilities, immunities or ignore abilities can define or impact how a game chip interacts with another game chip, including how it affects another game chip, is affected by another game chip, or otherwise affects game play. The capacity indicia 6' can be numerical values that quantify an associated characteristic.

As will be appreciated by those skilled in the art after reviewing this disclosure, expansion symbols can also be provided on the chips to indicate a set of chips to which a particular chip belongs. The color of the expansion symbol indicates rarity of the chip.

In FIGS. 3*a*-3*i* some example indicia are provided, such as dots 34 representing point values, words representing characteristics, and numbers representing capacities. However, dotted lines are also shown that can represent fields for any of a myriad of combinations of indicia that can be illustrated on the game chips, as will be appreciated by those skilled in the art after reviewing this disclosure. Also, the locations of the fields in various embodiments illustrated in the FIGS may be adjusted or varied and are not intended to be limiting. Finally, any of various quantities of dots 34 can be disposed on any of various game chips to indicate a plurality of different point values of the game chips, and the quantities of dots shown in drawings is not limiting.

A color of the chip—as well as an illustration which can be depicted in an illustration field 12' of the chip, as shown in FIGS. 3*a*-3*i*—can indicate what themed faction a chip belongs to. In some embodiments, the chips in a player's selected playing stack are required by associated rules to come from only one faction, but some embodiments also allow a limited number of neutral chips in a player's playing stack that do not belong to any particular faction.

Various chip types may be classified as troops, bases, actions, and artifacts. "Troop" chips can represent people and creatures players use to try to control the battlefield. Troop chips stay in play until an effect removes them and are worth points at the end of the game. They may also have abilities that activate when they are thrown.

"Base" chips can represent physical places on the battlefield, such as terrain and fortifications, and can be more difficult to destroy than troops. Extra points can be rewarded to players at the end of game play for each chip within range of a friendly base. A playing stack may be required to contain two bases in some embodiments.

"Action" chips can represent events, spells, and other commands that players use to sway the tide of a battle within some embodiments of the game. Action chips can be treated as activated when they are thrown but are removed at the end of the turn they are thrown. They cannot be attacked in any way and have no defense value.

"Artifact" chips can represent magical objects the player may use to get an edge in battle. They can be small personal objects, such as armor or weapons, or towering monoliths. Artifacts can act like troops and stay in play when thrown, but are unaffected by many of the abilities that affect troops.

Order of turns when deploying game pieces, such as the game chips, may proceed in a clockwise or counterclockwise manner between players, depending on the physical position of players gathered around a playing surface, and can remain the same throughout game play. During a player's turn, the player selects a chip from the player's playing stack and throws it onto the playing area. In some embodiments, for each player's first turn of a particular game, the player must throw a base chip and may throw any other chip type thereafter.

In some embodiments, the players are required by rules, such as written rules, to throw their chips in an arc (that is, in a manner in which the chip goes up from their hand before going down to the playing area) and from a certain distance above the playing surface, such as, for example, without limitation, one foot (1 ft) above the surface of the playing area. Players may also be prohibited from allowing their hands to enter any space above the playing area when throwing their game chips. Also, in some embodiments, the rules require that if a chip comes to rest outside of a defined playing area (by bouncing or rolling, for example) it is removed from play without any characteristic of the game chip being activated.

One type of characteristic indicia 4' depicted on some of the game chips are words that indicate game chip "abilities." An abilities list, describing game chip abilities, can be provided in written rules associated with certain embodiments of the game. Some abilities can be designated to activate upon throwing a game chip, while other abilities can activate at other times, or be optionally activated as selectable by a player. The abilities can be "standard" abilities that activate only once when the chip is thrown, but other abilities might be activated many times after a chip is thrown as other game chips land or rest within range. For example, "continuous" abilities activate immediately upon landing on the playing area and are always considered to effect game chips within range and are applied before other abilities.

Abilities can be activated and resolved in several stages. For example, first, movement abilities are activated. Movement abilities affect where a game chip ends up on the playing field after it is thrown and this may determine what abilities on other chips activate and are applied. After throwing a chip, a player determines all of the movement abilities that are activating and then resolves them. If two or more abilities indicate conflicting effects that are mutually exclusive and cannot all be resolved (such as moving the same chip to two or more different places), the player whose turn it is can decide which effect is applied and the conflicting abilities can be ignored.

Next, after all movement abilities have been resolved, other abilities may be activated. As with movement abilities, a player can determine what all of the activating abilities are and which chips they affect before resolving any of them. This can be important when chips remove each other from play. If a player resolves one of the abilities before activating the other, then the player might remove a chip before resolving its abilities. As when resolving movement abilities, if two or more different nonmovement abilities indicate effects that cannot all be resolved, the player whose turn it is decides which effect is applied and ignores the conflicting abilities.

"Rally" abilities can cause new abilities to be activated while a player is still resolving other abilities. When this happens, the player can wait until all other abilities have been resolved, and then start the process of applying abilities again for the newly activated abilities, starting with movement abilities and then applying other abilities. If multiple sets of these abilities have activated, the player can resolve each set separately.

In some embodiments, game chips that are removed from play go to a discard stack of the player who owns the chip. Game chips in the discard stack do not count for points.

After a chip has been thrown and the effects of all abilities that activate have been resolved, play passes to the next player, clockwise around the playing area.

Figure 3F:
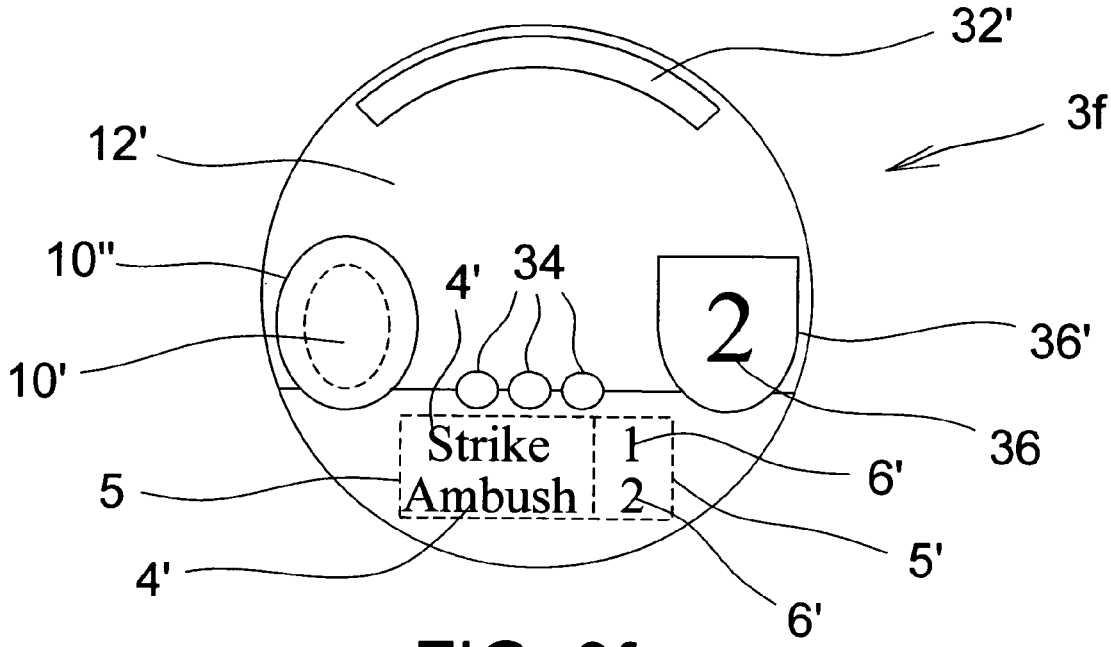

An example of game play in these embodiments of the present invention includes the following: Player 1 has one chip 3*f* on a playing area, as illustrated in FIG. 3*f*. The game chip has a defense value of 2 indicated in the defense indicia field 36'. The game chip 3*f* has two abilities indicated in the characteristics indicia field 5. The first ability is "Strike" and the capacity indicia 6' associated with the "Strike" ability is one (1). In the example, assume there are no game chips within range, so the strike ability cannot be activated. The second ability is "Ambush" with an associated capacity indicia 6' of two (2), which will remove any of Player 2's chips that have a defense of 2 or smaller that end up within range of Player 1's chip, such as, for example, being thrown within range of Player 1's game chip. Ambush is a continuous ability that it does not activate when the chip is thrown but instead can be activated with other nonmovement abilities whenever an opponent's chip enters its range.

Figure 3G:
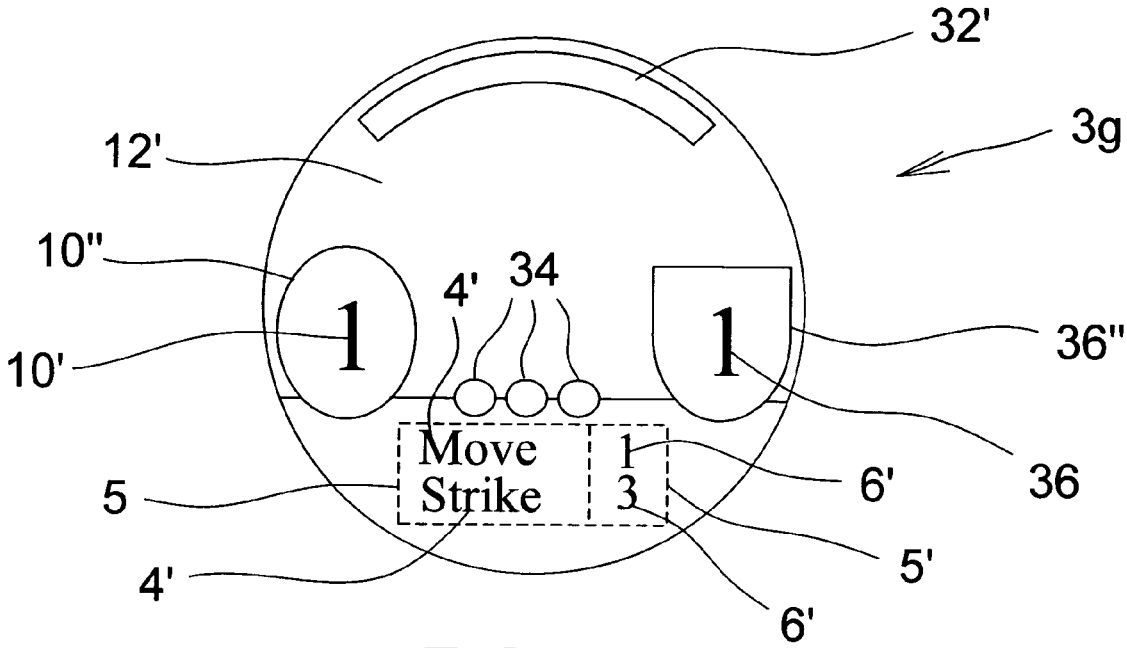
Figure 3H:
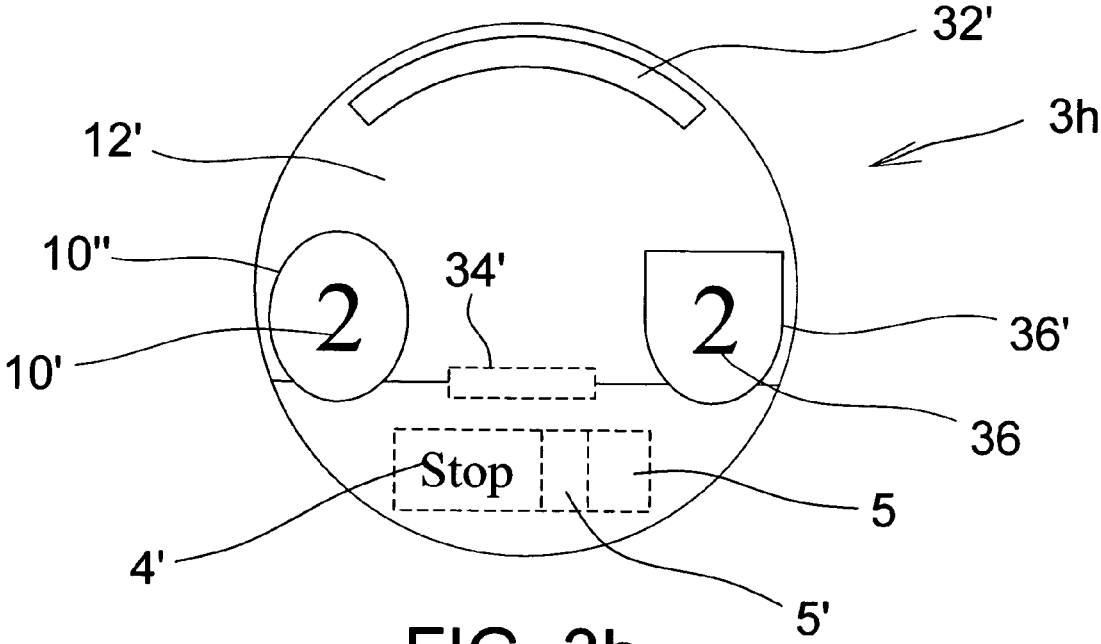
Figure 3I:
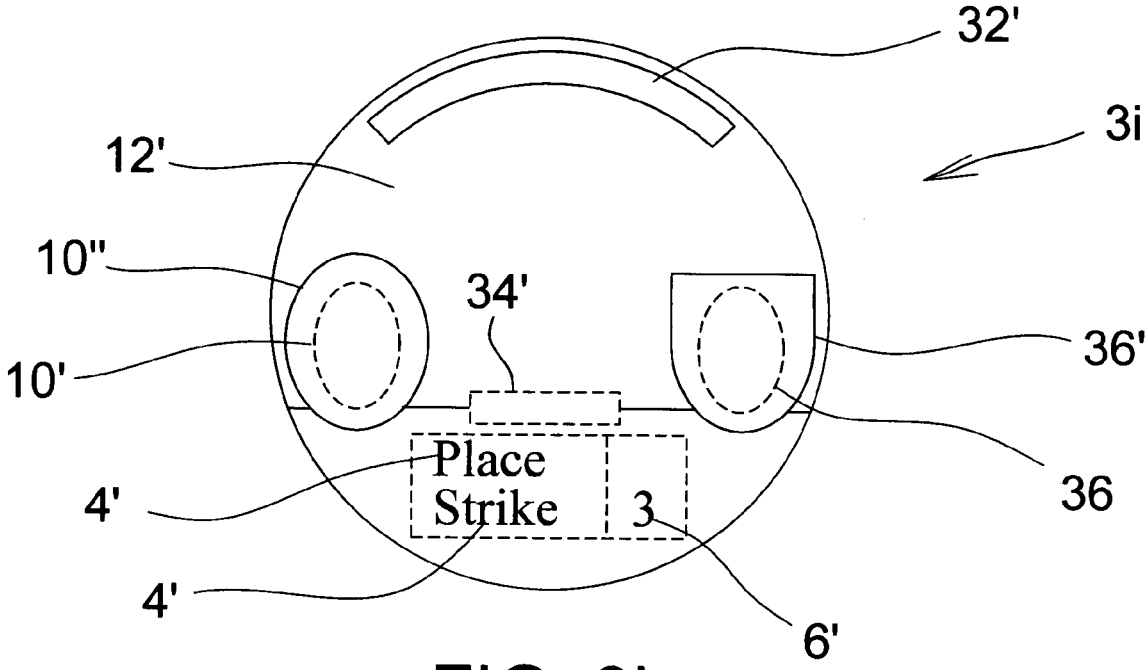

Player 2 then throws a troop chip, 3*g*, as shown in FIG. 3*g*. The troop chip 3*g* has a range of 1 and a defense of 1. It lands almost two range increments away from Player 1's game chip 3*f*. However, Player 2's game chip, 3*g*, has a "Move" ability with a capacity indicia of 1. Player 2 can therefore move the chip 3*g* one range increment, or unit, in any direction. Since "Move" is a movement ability, it must be resolved before other types of abilities are applied. Player 2 moves game chip 3*g* one range increment closer to Player 1's game chip, 3*f*, which is close enough to put Player 1's game chip in range of Player 2's game chip, according to the range indicia 10' on game chip 3*g* having a value of one (1).

Now that all of the movement abilities have been resolved, other abilities can be applied. Player 2's game chip 3*g* uses its strike ability on Player 1's game chip. Since Player 2's game chip's strike value is higher than the defense value of Player 1's game chip, Player 1's game chip will be removed. However, the effects of all activated abilities should be applied before removing any chips from play, so before Player 1's game chip, 3*f*, is removed, Player 1 gets to use the ambush ability of game chip 3*f*. Since the ambush ability of game chip 3*f* is associated with a capacity indicia having a value of 2, and this is greater than chip 3*g*'s defense value of 1, Player 2's game chip, 3*g*, is also removed from play.

Another example of game play includes the following: Player 1 has a Troop chip, 3*h*, in play, the chip being shown in FIG. 3*h*. It has a range of 2 and the continuous ability of "Stop." "Stop" prevents movement abilities from being activated within range of the chip, as shown in the abilities list below.

Player 2 has game chip 3*i* in her stack. See FIG. 3*i*. It has the ability "Place," which allows Player 2 to put the game chip 3*i* on the playing field or area wherever she would like instead of throwing it. Player 2 desires to place game chip 3*i* next to Player 1's game chip 3*h*, so that its Strike ability with a capacity of three (3) can remove game chip 3*h* from play; however, the "Stop" ability of game chip 3*h* prevents movement abilities from activating within its range, so Player 2 cannot use the "Place" ability to put it there. However, since "place" is an optional ability, Player 2 could choose to throw the chip normally and try to get it where she wants it.

In some embodiments, at the end of all player's turns, after all chips have been deployed from each player's playing-stack, and no players have any chips remaining, game play ends. Players can then total their points based on point values in the point indicia field 34' of all game chips remaining in the playing area, and the player with the most points wins. Each game chip remaining within the playing area is worth the number of points equal to its point value 34 indicated within the point indicia field 34'.

In some embodiments, each player's chips that lie within the range indicated on one or more base chips of the player is worth an additional one (1) point (e.g., a bonus point), and may also be worth more or less bonus points in other embodiments. Also, in some embodiments, being within the range of multiple base chips is not worth additional points. In some embodiments, the maximum number of bonus or additional points for a chip for being within range of a base chip is a set number of points (e.g., 1 point), regardless of how many bases it is in range of. Certain abilities, such as "loyal" and "drain," (see abilities list below) can modify the point value of chips. Also, in some embodiments, the last game chip thrown in the game is treated as though its point value were 0, regardless of its printed point value. It can, however, still earn points normally for being in a base chip's range and from abilities.

In various embodiments of the present invention, a substantial portion of game chips have abilities indicated by characteristics indicia 4' in a field 5 of the game chip. In some embodiments, the abilities activate only when the chip is thrown onto a selected playing area. Abilities can only affect other chips within range of the game chip with the ability, the range being indicated by range indicia 10'.

In some embodiments, all abilities can be "standard" abilities unless they are indicated as "continuous" abilities in the abilities list below. "Standard" abilities activate whenever appropriate—when the chip is thrown or when indicated in their ability description—but have no continuous effect on play. Continuous abilities produce a continuous effect while a game chip is in play. Upon landing in the playing area, the continuous abilities activate immediately and affect all chips within range, and they also affect any chip that later lands or rests within range of the chip. The effects of continuous abilities can be resolved before standard abilities are applied.

Some abilities may belong to one of several ability classes, such as movement abilities, attack abilities, and rally abilities. Movement abilities (such as "Exchange," "Attract," and "Repulse," from the list below) affect the final placement of chips; attack abilities (such as "Ambush," "Strike," and "Counterattack") can be used by players to attack opponents' chips, and rally abilities (such as "Command," "Rethrow," and "Reanimate") can cause another chip to activate. As will be understood by those skilled in the art after reviewing this disclosure, in various embodiments of the present invention, all movement abilities must be resolved before any other abilities may be applied.

In some embodiments of the present invention, the characteristics indicia on one or more game chips may indicate abilities comprised in the following list of abilities. An associated rule set or rule booklet may have the following list of abilities and descriptions to allow players to cross reference an ability indicated on a game chip against the rules (note that the "values" of abilities referenced below can indicate capacities of the abilities):

Example List of Abilities for an Embodiment of the Game of the Present Invention

| Ability | Description of Ability |
|---|---|
| Accuracy | After you throw this chip, you may choose to rethrow it. You may do so up to a number of times equal to its accuracy value. This is a movement ability. |
| Ambush. | Whenever one of your opponent's troops rests within range of this chip, compare the ambush capacity to that chip's defense. Remove the opponent's chip from play if its defense is lesser than or equal to the ambush capacity. This is an attack ability. You may choose not to activate this ability. |
| Artifact. | This ability identifies the chip as an artifact. Modifying or removing this ability does not change the type of the chip. This is a continuous ability. |
| Attract. | Move a number of troops in a range equal to the attract capacity directly toward this chip until they reach the edge of this chip. Stack chips if necessary. This is a movement ability. |
| Aversion. | Whenever one of your opponent's troops lands within range of this chip, it must be rethrown once. If it lands within range of any of your chips with aversion on the new throw, it is not rethrown again. This is a continuous ability. |

-continued

| Ability | Description of Ability |
|---|---|
| Base. | This ability identifies the chip as a base. Modifying or removing this ability does not change the type of chip. This is a continuous ability. |
| Bomb. | If any of your opponents' troops rest within range of this chip, then remove those chips and this one from play. |
| Boost. | Add the boost capacity to the attack abilities of any of your chips within range of this chip. This is a continuous ability. |
| Command. | Choose a number of your chips within range up to the command capacity and activate them, treating them as though they had just landed. Do not activate any rally abilities on those chips. This is a rally ability. You may choose not to activate this ability. |
| Counterattack. | When one of your opponents' troops uses an attack ability on this chip, compare the counterattack capacity to the defense value of the attacking chip. Remove that chip if its defense value is lesser than or equal to the counterattack capacity. This is an attack ability. You may choose not to activate this ability. |
| Destroy. | Remove from play a number of troops (yours and/or your opponents') within range equal to the destroy capacity. Chips that are closer to this chip must be removed before chips that are farther away. |
| Disloyal. | This chip is worth 1 point less at the end of the game for every opponent's chip within range. A chip cannot be worth less than 0 points. This is a continuous ability. |
| Exchange. | After throwing this chip, exchange its position with that of one of your other chips within range. This is a movement ability. You may choose not to activate this ability. |
| Fly. | For the purposes of determining whether this chip is within range of an opponents' chip without Fly, the distance between the two chips is increased by 1 range increment. The range is not adjusted when applying the abilities of chips that have Fly or when applying this chip's abilities to other chips. This is a continuous ability. |
| Loyal. | This chip is worth 1 additional point at the end of the game if any other chip of yours is within range. This is a continuous ability. |
| Master. | Chips that are within range of a chip with master may use M abilities. This is a continuous ability. |
| Move. | On the turn this chip is thrown, the owner may move the chip up to the move capacity in range increments from its landing position. This is a movement ability. You may choose not to activate this ability. |
| Push. | On the turn this chip is thrown, the owner may move another of their chips within range up to the push capacity in range increments. This is a movement ability. You may choose not to activate this ability. |
| Stop. | No chips within range of this chip can activate movement abilities. They may still be removed from play. This is a continuous ability. |
| Place. | You may place this chip anywhere on the field instead of throwing it. You may choose not to activate this ability and throw the chip normally. The chip activates as though thrown. This is a movement ability. |
| Poison. | Any troops without the poison ability that rest within range of this chip are removed. |
| Possess. | You gain control of an opponent's chip within range of your choice. As long as that chip is in play and in range, apply all rules as though the chip were yours, including scoring points at the end of the game. Control returns to the previous owner if this chip is removed or moved out of range. |
| Protect. | Increase the defense of all of your troops within range by the protect capacity. This is a continuous ability. |
| Provoke. | When choosing the target of an attack ability, a player must choose a chip with provoke before a chip without provoke. This is a continuous ability. |
| Raze. | Remove from play a number of bases (yours and/or your opponents') within range equal to the raze capacity. Chips that are closer to this chip must be removed before chips that are farther away. |
| Reanimate. | Remove from play one of your troops within range, then select one of the other troops in your discard stack and throw it. You may not throw one of the troops from your discard stack unless you removed one of your troops from play. The chip activates normally when thrown except that none of its rally abilities activate. This is a rally ability. |

-continued

| Ability | Description of Ability |
|---|---|
| Repulse. | Move a number of your opponent's troops equal to the repel capacity directly away from this chip until they are outside of the range of this chip. This is a movement ability. |
| Replace. | Do not throw this chip. Instead, you must remove one of your other chips from play and place this one in its position. This chip activates as though thrown. |
| Rethrow. | Pick up another of your chips within range and throw it. That chip activates. Do not activate any rally abilities on the chip. This is a rally ability. You may choose not to activate this ability. |
| Siege. | Choose one of your opponent's bases within range. Compare its defense value to the siege capacity. Remove that chip from play if its defense value is lesser than or equal to the siege capacity. This is an attack ability. You may choose not to activate this ability. |
| Strike. | Choose one of your opponent's troops within range of this chip and compare its defense to the strike capacity. Remove that chip from play if its defense is lesser than or equal to the strike capacity. This is an attack ability. You may choose not to activate this ability. |
| Support. | Increase the range of all of your other chips within range by the support capacity. This is a continuous ability. |
| Team. | The capacity of all attack abilities for this chip are increased by 1 for each of your other chips with team within range. This is a continuous ability. |
| Trap. | Choose a number of all opponents' troops within range equal to the trap capacity. Ignore the point values and all abilities of those chips. |
| Unique. | You may not throw this chip if another copy of it is on the playing area. This is a continuous ability. |
| Weaken. | The capacity of all attack abilities for all opponents' chips within range is lowered by the weaken capacity. This is a continuous ability. |

Some embodiments of game chips have "immunities" to certain abilities, which can be indicated by parentheses around the ability's indicia. A game chip that is immune to an ability cannot have that ability applied to it. For example, (assault) means that the ability assault cannot be applied to the game chip.

Other game chips can have an "ignore" characteristic to ignore certain abilities, which is indicated by brackets around the ability's name. A game chip that can ignore a certain ability treats game chips within its range as though they do not have that ability. For example, the game chip 3*b*, in FIG. 3*b*, has characteristic indicia 4' of "Assault" next to "[fly]," which means its characteristics include that it has an "Assault" ability and can ignore game chips with "Fly" abilities when utilizing "Assault." Therefore, when a player using game chip 3*b* applies an the assault ability toward another chip with a "Fly" ability, the player treats that other game chip as though it does not have the Fly ability. However, that other chip still has Fly abilities in relation to other abilities that game chip 3*b* may have and utilize (e.g., such as another ability indicated on the game chip beneath the text "Assault 4 [fly]").

Some embodiments of the present invention also comprise ability "modifiers" that can be indicated in one of the characteristics indicia fields 5, and can be indicated by an indicia positioned adjacent an ability indicia. In such embodiments, the abilities list describes what each ability does normally. However, "modifiers" modify an associated ability to create slightly different effects if an ability modifier indicia appears next to the ability. In some embodiments, these modifiers can be indicated by letters after the ability. As will be appreciated by those skilled in the art after reviewing this disclosure, in some embodiments of the present invention, associated rules may list and describe ability modifiers as follows for use as a reference by players:

Example List of Ability Modifiers for an Embodiment of the Present Invention

1. An all ability (A ability) affects all chips (both yours and opponents') within range of the chip. This modifier is applied to abilities that normally only affect a limited number or type of chip. If this modifier is on an ability that you can choose not to activate, you may still choose not to activate it.

2. A friendly ability (F ability) affects only your chips. This modifier is applied to abilities that normally don't affect your chips or that normally affect all chips. If this modifier is on an ability that you can normally choose not to activate, you do not have that choice any longer and must activate the ability.

3. An opponents' ability (O ability) affects only opponents' chips. This modifier is applied to abilities that normally don't affect opponents' chips or that normally affect all chips.

4. A remove ability (R ability) does not activate automatically. Instead, you may choose whether or not to activate it when you throw the chip. If you choose to activate it, then you must remove the chip from the playing area at the end of the turn. (Like the "R" on action chips, the "R" here helps you remember to remove the chip at the end of the turn in which it is thrown).

5. A master ability (M ability) can only be activated if the chip is within range of another chip with the ability master.

In some embodiments, symbols are used for these ability modifiers, rather than letters.

In some embodiments of the present invention, players treat range indicia as representing different distances or units of measurement for different players. For example, if it is desired to "handicap" certain players, some players may treat each range value as two inches, while others treat each range value as four inches on their respective game chips. In this manner, the players that treat each range value of their game chips as representing four inches are not required to throw their game chips as near to targeted game chips.

In some embodiments, when players first start playing certain embodiments of the present invention, and have limited numbers of game chips, it may be permissible to play with a stack of any fifteen chips. However, the following rules for constructing stacks can be applied in some embodiments of the present invention to ensure that players have even footing:

(a) A playing stack must have exactly fifteen chips.

(b) A playing stack can have no more than three copies of any chip.

(c) A playing stack can have no more than one copy of any chip with the ability unique.

(d) The chips in any player's playing stack may not come from more than one faction. In general, this may mean that all the chips are the same color. However, the playing stack may contain up to two neutral chips.

(e) The total point value of all chips in the playing stack must be 25 or less.

(f) The stack must contain exactly two base chips.

As will be appreciated by those skilled in the art after reviewing this disclosure, in various other embodiments, the above listed parameters (a) through (f) may be modified, such as by, for example, requiring less than fifteen game chips, or more than fifteen game chips.

As those skilled in the art will appreciate after reviewing this disclosure, it is also contemplated that various embodiments of the present invention can be implemented with existing and readily available electronic devices, such as computers, video games, electronic games, and on interactive networks utilizing computer software, text and graphics. Such electronic devices can visually display the game components and enable the players to manipulate the game components, simulating projections of the game components by players on an electronically generated display system, and executing turns as described hereinabove. The projecting of game pieces can be simulated in these various electronic devices using various well-known methods that permit game players to use keys and other input actuating members to project objects, or game components. The game components or objects in these electronic embodiments may also be associated with specific ranges that are utilized in playing the electronic embodiments of the present invention in connection with various indicia and their interactive effects, such as disclosed above. For example, the range indicia can be indicated on fixed or variable locations on a display screen and be notated for association with specific game components, or can be indicated on the electronically generated images of the game components, as will be appreciated by those skilled in the art.

Although specific embodiments and examples of the invention have been described herein for illustrative purposes, various equivalent modifications can be made without departing from the spirit and scope of the invention, as will be recognized by those skilled in the relevant art after reviewing the present disclosure. The various embodiments described can be combined to provide further embodiments. The described game components, such as game pieces, game chips, and measurement devices, and methods of playing games, can omit some elements or acts, can add other elements or acts, or can combine the elements or execute the acts in a different combinations and orders than that illustrated above, to achieve various advantages of the invention. These and other changes can be made to the invention in light of the above detailed description.

In general, in the following claims, the terms used should not be construed to limit the invention to the specific embodiments disclosed in the specification. Accordingly, the invention is not limited by the disclosure, but instead its scope is determined entirely by the following claims.

What is claimed is:

1. A method of playing a game comprising a plurality of collectable game components, with the plurality of game components each having associated range indicia and associated characteristic indicia, with at least two of the range indicia representing different range values, the method comprising:

deploying at least a first game component and at least a second game component by projecting said game components onto a playing surface; and determining a distance between said first game component and said second game component to determine if the game components are within range of one another as defined by a range value associated with at least one of said game components, and wherein an outcome of the game is affected by said determination.

2. The method of claim 1 further comprising eliminating one of the game components from play if the first game component and second game component are within said range of one another.

3. The method of claim 1 further comprising displacing one of said game components with respect to the surface if the first game component and the second game component are within said range of one another.

4. The method of claim 3 wherein displacing the game component comprises moving the game component after it is projected onto the surface and wherein projecting a game component on the surface comprises throwing the game component.

5. The method of claim 1 further comprising projecting a particular game component a plurality of times, the maximum number of plurality of times being dependent on an indicia of the particular game component.

6. The method of claim 1 wherein the range value used to determine if the game components are within range of one another is a range value associated with the second game component, and wherein the second game component is projected after the first game component.

7. The method of claim 1 wherein the range value used to determine if the game components are within range of one another is a range value associated with the first game component, and wherein the second game component is projected after the first game component.

8. The method of claim 7 further comprising projecting a third game component onto the playing surface and determining if the third game component is within range of the second game component based on a range value associated with the third game component.

9. The method of claim 1 further comprising moving at least the first game component toward the second game component if the first game component is within a range of the second game component.

10. The method of claim 1 further comprising applying an interaction between the first game component and second game component according to a characteristic indicia associated with at least one of the game components, if the first game component and the second game component are outside of a range defined by the range value associated with at least one of the game components, the interaction affecting a point value accounting for a player.

11. The method of claim 1 further comprising players applying an interaction between at least two of the plurality of game components if they are within said range of one another, said interaction being applied in accordance with a characteristic indicia of at least one of the game components with the characteristic indicia being capable of being cross-referenced to a description of characteristics within a rule set associated with said game, and wherein determining the distance between two game components includes utilizing a measurement element that is at least one of a playing surface marked with measurement indicia and an elongated measurement device.

12. The method of claim 11 wherein the interaction comprises the step of a player of the game re-throwing the first game component after the first game component has already been previously deployed.

13. The method of claim 11 further comprising eliminating at least both the first game component and second game component from play of the game if the game components are within range of one another as defined by a range indicia associated with at least one of the game components.

14. The method of claim 11 wherein applying the interaction comprises the step of a player utilizing an ability on said first game component if the second game component is deployed within a range of the first game component, and wherein both the first and second game components are game components deployed by the same player.

15. The method of claim 11 wherein applying the interaction comprises eliminating the first game component from play as a function of both a characteristic indicia and capacity indicia on the second game component and a quantifiable indicia of the first game component.

16. The method of claim 15 further comprising removing the second game component from play as a function of both a capacity indicia on the first game component and a quantifiable indicia of the second game component, whereby the first game component counterattacks the second game component.

17. The method of claim 11 wherein applying the interaction comprises exchanging a position of the first game component with a position of the second game component on the playing surface.

18. The method of claim 11 wherein applying the interaction comprises moving at least one of the game components after it has been projected onto the playing surface, the distance of the movement being a function of an indicia associated with at least one of the moved game component and another game component.

19. The method of claim 11 wherein applying the interaction comprises comparing a characteristic indicia associated with the second game component against a characteristic indicia of the first game component and eliminating at least one of the game components from play to a discard stack, with said elimination being a function of said comparison.

20. The method of claim 11 further comprising selectably placing a third game component on the playing surface, such that a player is not required to throw said third game component.

21. The method of claim 11 wherein applying the interaction comprises eliminating at least three game components from game play during player turns in which each of the three game components are deployed with each of the three game components being projected within a range of said first game component.

22. The method of claim 11 wherein applying the interaction comprises allowing a first player to control a second player's game component during game play if the second player's game component is within a range of another game component.

23. The method of claim 11 wherein applying the interaction comprises re-deploying a game component that was previously eliminated from play and displaced from said surface as a function of whether the second game component is deployed within said range of the first game component, and wherein said range is based on a range indicia of the second game component.

24. The method of claim 11 wherein applying the interaction comprises moving the first game component away from said second game component on said playing surface, wherein the first game component was projected onto the playing surface prior to the second game component, and the second game component was projected onto the playing surface and came to rest within range of the first game component according to a range indicia associated with the second game component.

25. The method of claim 11 further comprising replacing at least one of the first game component and second game component on the playing surface with a third game component, wherein the third game component subsequently occupies a location on the playing surface previously occupied by at least one of the first game component and second game component and wherein at least one of the first game component and second game component is removed from the playing surface.

26. The method of claim 11 wherein applying said interaction comprises increasing a range value associated with the first game component as a function of a quantitative indicia of the second game component such that a player in control of the first game component can determine whether another game component is within range of the first game component using a range value higher than that initially represented by a range indicia on the first game component.

27. The method of claim 26 wherein both the first game component and second game component are game components belonging to a same player.

28. The method of claim 1 wherein the associated range values are associated with said game components by being indicated on said game components with numerical values.

29. The method of claim 1 wherein at least one of said game components has an attachment member coupled thereto capable of being used to identify player ownership of a particular game component and wherein the attachment member is detachable by a player.

30. A method of playing a game using a plurality of game chips, with each game chip having an associated range value with at least two of the range values being different in value, the method comprising:

deploying at least a first game chip and at least a second game chip by tossing the game chips onto a playing surface; and measuring a distance between the first game chip and second game chip using a measurement device and comparing the measured distance against a range value associated with at least one of the game chips, and wherein an outcome of the game can be affected by the result of the comparison.

* * * * *